US011691188B2

(12) United States Patent
Scherer et al.

(10) Patent No.: US 11,691,188 B2
(45) Date of Patent: Jul. 4, 2023

(54) METHOD AND DEVICES FOR CLEANING AT LEAST ONE BREATHING APPARATUS

(71) Applicant: MEIKO Maschinenbau GmbH & Co. KG, Offenburg (DE)

(72) Inventors: Marc Scherer, Hofstetten (DE); Marijan Simundic, Ohlsbach (DE); Herbert Falk, Offenburg (DE); Heiko Wörner, Bühl (DE)

(73) Assignee: MEIKO Maschinenbau GmbH & Co. KG, Offenburg (DE)

( * ) Notice: Subject to any disclaimer, the term of this patent is extended or adjusted under 35 U.S.C. 154(b) by 312 days.

(21) Appl. No.: 17/042,844

(22) PCT Filed: Mar. 28, 2019

(86) PCT No.: PCT/EP2019/057883
§ 371 (c)(1),
(2) Date: Sep. 28, 2020

(87) PCT Pub. No.: WO2019/185809
PCT Pub. Date: Oct. 3, 2019

(65) Prior Publication Data

US 2021/0016332 A1 Jan. 21, 2021

(30) Foreign Application Priority Data

Mar. 28, 2018 (DE) ..... 102018204763.4

(51) Int. Cl.
*B08B 9/00* (2006.01)
*B08B 5/00* (2006.01)
(Continued)

(52) U.S. Cl.
CPC ..... *B08B 9/00* (2013.01); *A62B 99/00* (2013.01); *B08B 5/00* (2013.01); *B08B 13/00* (2013.01)

(58) Field of Classification Search
None
See application file for complete search history.

(56) References Cited

U.S. PATENT DOCUMENTS 3,558,833 A * 1/1971 McCrory, Jr. ..... H04R 29/00 381/54
3,881,503 A 6/1975 Fox et al.
2015/0314340 A1* 11/2015 Falk ..... B08B 9/0328 134/99.1

FOREIGN PATENT DOCUMENTS

DE 20003743 U1 2/2000
DE 20003744 U1 7/2000
(Continued)

OTHER PUBLICATIONS

Unauthored, DIN EN136:1998-04,Atems hutzgeräte-Vollmasken-Anforderungen,Prüfung,Kennzei hnung,aufS.19der EN136; Respiratory protective devices —Full face masks—Requirements, testing, marking; Jan. 1988, 11 pages.

*Primary Examiner* — Eric W Golightly
*Assistant Examiner* — Arlyn I Rivera-Cordero
(74) *Attorney, Agent, or Firm* — Ice Miller LLP

(57) ABSTRACT

A method for cleaning a breathing apparatus comprising a respiratory mask, by such precleaning activity as: providing the breathing apparatus in an externally contaminated state, providing a holder for the respiratory mask having at least one curved sealing face and stretching the respiratory mask onto the holder such that a sealing lip of the respiratory mask lies on the curved sealing face and closes off an interior of the respiratory mask, and the holder with the respiratory mask may be introduced into a precleaning chamber, exposing an outer side of the respiratory mask in the precleaning chamber to at least one precleaning fluid. And, after the precleaning, the respiratory mask may be released from the holder, introducing the respiratory mask into a primary
(Continued)

cleaning chamber and exposing the respiratory mask, including an inner side of the respiratory mask that faces the interior, to a primary cleaning fluid.

15 Claims, 5 Drawing Sheets

(51) Int. Cl.
*B08B 13/00* (2006.01)
*A62B 99/00* (2009.01)

(56) References Cited

FOREIGN PATENT DOCUMENTS

| | | | |
|---|---|---|---|
| DE | 10020835 | A1 | 11/2001 |
| DE | 102005033618 | B3 | 11/2006 |
| DE | 102007009936 | A1 | 9/2008 |
| DE | 102007012768 | B4 | 9/2008 |
| DE | 102012220646 | B3 | 3/2014 |
| EP | 0935687 | B1 | 8/1999 |
| EP | 1088928 | A1 | 4/2001 |
| EP | 3120899 | A1 | 1/2017 |
| WO | WO2011/144518 | A2 | 11/2011 |

* cited by examiner

METHOD AND DEVICES FOR CLEANING AT LEAST ONE BREATHING APPARATUS

CROSS-REFERENCE TO RELATED APPLICATIONS

The present application is a Section 371 of International Patent Application Serial No. PCT/EP2019/057883, filed Mar. 28, 2019, and also claims the priority benefit of German Patent Application Serial No. 102018204763.4, filed Sep. 29, 2018, the text and drawings of which are hereby incorporated by reference in their entireties.

TECHNICAL FIELD

The invention relates to a method for cleaning at least one breathing apparatus, the breathing apparatus comprising at least one respiratory mask. The invention further relates to an appliance for cleaning at least one breathing apparatus, to a precleaning appliance for precleaning personal protective equipment, and to a cleaning system for cleaning personal protective equipment, more particularly at least one breathing apparatus having at least one respiratory mask. Appliances and methods of these kinds can be employed generally in order to clean breathing apparatuses or constituent parts thereof, such as, for example, breathing apparatuses for emergency services such as fire departments, technical aid organizations or emergency paramedics, breathing apparatuses for divers or, generally, individuals in hostile or critical working environments, and also for armed forces and security forces such as police officers, for example. For breathing apparatuses in the medical sector as well, examples being respiratory masks for oxygen supply and surgical operations, it is possible to employ the proposed appliances and methods. A field of use contemplated in particular is, generally, cleaning of respiratory masks or breathing regulators.

TECHNICAL BACKGROUND

Breathing apparatuses such as, for example, respiratory protection masks or breathing regulators are generally a constituent part of the personal protective equipment of, for example, emergency services, armed forces or security forces. Accordingly, a multiplicity of breathing apparatuses are known from the prior art for a variety of end uses. For example, emergency services such as fire departments use respiratory protection masks with filters to remove harmful constituents from the inspired air drawn in. In many cases, however, alternatively or additionally to a filter, a so-called breathing regulator is used, via which the user can be ventilated with a respiratory gas, such as pressurized air, for example. Breathing regulators generally enable a user to breathe from a pressurized-gas bottle or from some other pressurized-gas connection and in this way, for example, to remain under water or in some other atmosphere that is unbreathable or toxic. For this purpose, the pressurized gas, compressed air for example, from the pressurized-gas connection is adapted by the breathing regulator to a pressure prevailing in a working environment of the user.

The breathing apparatuses or constituent parts thereof must in general be cleaned, sanitized, dried, checked and, where appropriate, be furnished, and packaged after every deployment. All contamination resulting from the usage or storage must be removed with the cleaning process, so that the breathing apparatuses can be provided in a macroscopically clean and hygienically satisfactory condition, for the next steps of a preparation process, for example. The same requirements are in general also valid for other constituent parts of breathing apparatuses, such as respiratory mask attachments and accessories, for example, of which filters or breathing regulators are examples. Since breathing apparatuses and their constituent parts are, in general, safety-relevant appliances, there are a number of requirements to be observed in the cleaning of these appliances. In addition to sufficient cleaning and sanitization, for example, it is necessary in many cases to ensure that accessories remain assigned to the respective respiratory masks, for technical reasons. A further general requirement is that gas-conducting regions of certain elements of breathing apparatuses, examples being gas-conducting regions of breathing regulators, shall not come into contact with cleaning fluid—not with water and/or cleaning solution, for example.

In many cases, breathing apparatuses, such as respiratory masks and their accessories, for example, are either cleaned by hand or washed in modified laundry washing machines, with the aid of protective bags and/or with the aid of adapters. For example, EP 0 935 687 B1 discloses, generally, a washing machine which has a washing tub with a drum. A shell of the drum has a bulge structure directed toward the drum interior, with holes arranged on edge contours, directed toward the drum exterior, of the bulge at its corner points. With such washing machines it is possible in principle to realize particularly gentle cleaning of items of equipment for emergency services.

EP 1 088 928 A1 discloses a holding system for respiratory protection masks in a laundry treatment machine. The holding system has a carrying bracket which is arranged so as to corotate in a drum of the laundry treatment machine, and to which the respiratory protection masks can be connected.

DE 200 03 743 U1 and DE 298 22 172 U1 each disclose appliances for the treatment of protective suits. In these cases, clothes hangers are used which comprise flexible air outlet nozzles. The clothes hangers are each fastened on a pivot device. The cleaning of breathing apparatuses is generally possible only with difficulty, if at all, by means of the appliances shown.

DE 10 2005 033 618 B3 discloses an appliance for cleaning respiratory protection masks. The appliance comprises a closeable housing and at least one receptacle, arranged in a carrier, for at least one respiratory protection mask. Further provided are a nozzle arrangement and a brush arrangement, with the respiratory protection masks being brushed by a movement of the respiratory protection masks. By means of the appliance disclosed, however, there is no possibility for individual assignment and cleaning of mask accessories. Moreover, the cleaning of gas-conducting elements, such as breathing regulators, for example, is not possible with the appliance disclosed. DE 200 03 744 U1 also discloses an appliance for the cleaning, disinfection, and drying of respiratory protection masks, comprising a carrying frame with an assigned nozzle system and individual treatment places. This appliance too is fundamentally unsuited to the cleaning of gas-conducting elements and accessories.

DE 10 2007 009 936 A1 discloses a cleaning appliance for pressurized-air breathing apparatuses. It has an accommodation space, delimited by a protective grille, and has rotating nozzle carriers. The nozzle carriers are located outside the protective grille. A disadvantage of the appliance presented, however, is that cleaning liquid can penetrate into gas-conducting regions.

Conversely, the cleaning of sensitive components of breathing apparatuses, such as breathing regulators, for example, is generally accomplished manually. Where appropriate, manual cleaning may be assisted by placement into ultrasound cleaning units. DE 10 2007 012 768 B4, however, discloses a method and an appliance for the cleaning of breathing regulators. Here, the articles for cleaning are placed onto holders on a rotating element and are immersed repeatedly into a liquid bath with cleaning liquid, disinfecting liquid, and rinsing liquid. Breathing regulators in this case are first exposed to pressurized air in order to establish a seal between valve and hose connection, and are thereafter immersed into the liquid bath. A disadvantage of immersion methods of this kind, however, is that cumbersome holders with corresponding actuators are required in order to ensure, through corresponding movements, that cleaning fluid is removed from the various cavities after the cleaning procedure.

DE 100 20 835 A1 describes an appliance for treating respiratory protection masks. A receptacle for populating with respiratory protection masks is provided, and the respiratory protection masks are coupled to the receptacle by means of the breathing apparatus connection. Additionally described is the provision, in a cabin of the appliance, of a collecting device for collecting treatment agents, along with a pump for supplying the treatment agents.

U.S. Pat. No. 3,881,503 A discloses an appliance for washing and decontaminating articles of anesthetic equipment. A nozzle system is provided by means of which water jets can be sprayed at high pressure onto the items for cleaning.

DE 11 74 169 B describes an appliance for cleaning respiratory protection masks. Here, in a housing, a rotatably mounted tubular frame is provided, wherein the masks for cleaning are stretched over holders. By means of the rotary frame, the respiratory protection masks are conveyed with a rotational movement through a bath of a cleaning liquid in a tub.

WO 2011/144518 A2 describes a cleaning appliance for cleaning breathing apparatuses. The cleaning appliance comprises at least one cleaning chamber for accommodating at least one breathing apparatus, and also at least one fluid device for exposing the breathing apparatus to at least one cleaning fluid. The cleaning appliance additionally has at least one pressure exposure apparatus with at least one pressure connection. The pressure connection is connectable to at least one gas-conducting element of the breathing apparatus. The pressure exposure apparatus is configured to expose the gas-conducting element to pressurized gas.

In spite of the advantages which have been and are achieved with the above-described appliances and methods, there are numerous technical challenges that remain. For instance, it is commonly the case that the components of the personal protective equipment (PPE) are cleaned and disinfected after deployment. A difficulty which exists, however, is that the entrainment of noxiants from an outer side of the respiratory masks to an inner side ought to be avoided. Cleaning may be accomplished manually, for example, by rinsing to remove coarse contamination especially on the outside on the individual parts such as the respiratory masks. This operation, however, is comparatively difficult to automate. Moreover, a considerable risk exists that fire residues such as soot, possibly containing substances posing a hazard to health, may be entrained to an inner side of the respiratory mask by means of washing liquor, for example. There is also a risk, moreover, of hazardous and unwanted substances being entrained from the precleaning step into the ultimate or primary cleaning step.

OBJECT OF THE INVENTION

It would therefore be desirable to provide a method and an appliance which at least largely avoid the disadvantages of known methods and appliances. Desirable in particular would be a reliable and simple cleaning of personal protective equipment from external contaminations such as fire residues, with entrainment of these contaminations being avoided.

DISCLOSURE OF THE INVENTION

This object is addressed by a method, an appliance, a precleaning appliance, and a cleaning system, having the features of the independent claims. Advantageous developments, which can be realized individually or in any desired combination, are set out in the dependent claims.

Below, the terms "exhibit", "have", "comprise", or "include" or any grammatical deviations therefrom are used in a nonexclusive way. Accordingly, these terms may refer both to situations in which there are no further features present other than the features introduced by these terms, or to situations in which there are one or more further features present. For example, the expression "A exhibits B", "A has B", "A comprises B" or "A includes B" may refer both to the situation in which, apart from B, no further element is present in A (i.e., to a situation in which A consists exclusively of B), and to the situation in which, additionally to B, there are one or more further elements present in A—for example, element C, elements C and D, or even further elements.

Furthermore, it is pointed out that the terms "at least one" and "one or more" and also grammatical modifications of these terms, if used in conjunction with one or more elements or features and intended to express that the element or feature may be provided singly or multiply, are generally used only once, as when the feature or element is introduced for the first time, for example. In the event of any subsequent repeat mention of the feature or element, the corresponding term "at least one" or "one or more" is generally no longer used, without restricting of the possibility that the feature or element may be provided singly or multiply.

Below, moreover, the terms "preferably", "more particularly", "for example" or similar terms are used in conjunction with optional features, without alternative embodiments being restricted as a result. Hence features introduced by these terms are optional features, and there is no intention for these features to limit the scope of protection of the claims and more particularly of the independent claims. Hence the invention, as the skilled person will recognize, can also be carried out using other configurations. Similarly, features introduced by "in one embodiment of the invention" or "in one exemplary embodiment of the invention" are understood to be optional features, without this being intended to limit alternative configurations or the scope of protection of the independent claims. It is the intention, furthermore, that these introductory expressions should not affect all of the possibilities of combining the features introduced thereby with other features, whether these be optional or nonoptional features.

In a first aspect, the present invention relates to a method for cleaning at least one breathing apparatus comprising at least one respiratory mask. The method comprises at least one precleaning step, the precleaning step having the substeps below, preferably in the order stated. Any other order is also possible in principle. Also possible, more particularly is an entirely or partly synchronous performance of the method steps. Furthermore, individual, two or more, or all of the steps, more particularly all of the substeps, in the method may be performed repeatedly, more particularly more than once. Further to the method steps stated, the method may also comprise further method steps.

The substeps of the precleaning step of the method for cleaning at least one breathing apparatus are as follows:

a) providing the breathing apparatus in an externally contaminated state;
b) providing at least one holder for the respiratory mask, the holder having at least one curved sealing face;
c) stretching the respiratory mask onto the holder such that a sealing lip of the respiratory mask lies on the curved sealing face and closes off an interior of the respiratory mask;
d) introducing the holder with the respiratory mask into a precleaning chamber; and
e) exposing an outer side of the respiratory mask in the precleaning chamber to at least one precleaning fluid.

The term "breathing apparatus" as it is used here is a broad term which is to be accorded its usual and common meaning as it is understood by the skilled person. The term is not restricted to a specific or adapted meaning. The term may, without restriction, refer in particular to an appliance which is configured in a suitable way for protecting the respiratory tracks of a user from harmful influences. For example, the breathing apparatus may be an appliance which is configured for the complete or partial filtering of ambient air and/or for the provision of respiratory gas to at least one user. These breathing apparatuses may be complete, operationally ready breathing apparatuses, or else constituent parts thereof, and consequently no distinction is made below, in terms of terminology, between breathing apparatuses and their constituent parts. In any case, however, the breathing apparatus comprises at least one respiratory mask. The breathing apparatuses may more particularly and further have one or more of the following elements: respiratory protection masks, hoses, valves, filters, pressurized-gas containers, breathing regulators, or combinations of the stated and/or other elements.

The term "respiratory mask" as it is used here is a broad term which is to be accorded its usual and common meaning, as it is understood by the skilled person. The term is not restricted to a specific or adapted meaning. The term, without restriction, may refer more particularly to a device which covers all or part of a facial region of a user, intended to provide coverage at least to the mouth and nose region. In particular, the respiratory mask may have a wall, which is preferably of completely or partially flexible design and which covers the mouth and nose and also, optionally, further regions of the face such as the eyes, for example, and also has at least one sealing lip, which seals the respiratory mask against the face, so forming a sealed-off region between face and respiratory mask. Additionally, and particularly if the face is covered completely or at least largely, the respiratory mask may have at least one viewing window. Furthermore, as will be explained below in more detail, the respiratory mask may have at least one fixing for fastening on the head of the user—for example, at least one belt, at least one fixing band or at least one fastening which consists of a plurality of bands and is frequently referred to as banding or webbing. The respiratory mask may, for example, have at least one opening and may, for example, be configured to enable an air supply or respiratory-gas supply. For example, the respiratory mask may have at least one thread for connecting a respiratory-gas supply. Additionally, for example, the respiratory mask may have at least one exhalation valve. The respiratory mask may be produced, for example, wholly or partly of a flexible material, more particularly of at least one elastomer material, such as rubber and/or silicone, for example.

The term "clean" as it is used here is likewise a broad term which is to be accorded its usual and common meaning as it is understood by the skilled person. The term is not restricted to a specific or adapted meaning. The term, without restriction, may refer in particular to the removal of adhering dirt or other impurities from material for cleaning or an article for cleaning, and also, optionally, to a germ-reducing and/or germicidal activity or even a disinfecting activity.

The term "precleaning step" as it is used here is likewise a broad term which is to be accorded its usual and common meaning as it is understood by the skilled person. The term is not restricted to a specific or adaptive meaning. The term, without restriction, may refer in particular to a substep in a cleaning method which in addition to the precleaning step comprises at least one further cleaning step downstream of the precleaning step. The precleaning step may in particular be designed to free articles for cleaning from coarse impurities or else highly toxic impurities or else impurities in relatively large quantities before, subsequently, they are cleaned of the remaining impurities in a downstream cleaning step.

The term "externally contaminated state" as it is used here is likewise a broad term which is to be accorded its common and usual meaning as it understood by the skilled person. The term is not restricted to a specific or adapted meaning. The term, without restriction, may refer in particular to a condition of the breathing apparatus in which at least one outer side of the breathing apparatus—that is, a side of the breathing apparatus which in the use scenario is exposed to the ambient surroundings, such as the ambient air, for example—is contaminated with impurities. Contamination here may refer generally, to a state of an element in which impurity adheres to the element. For example, the externally contaminated state may be a state in which, after use in a smoky environment, fire residues, soot or other deposits typically encountered in the deployment of the fire departments adhere externally to the breathing apparatus.

The term "holder for the respiratory mask" as it is used here is likewise a broad term which is to be accorded its usual and common meaning as it is understood by the skilled person. The term is not restricted to a specific or adapted meaning. The term, without restriction, may refer in particular to an appliance which has a curved sealing face onto which a sealing lip of the respiratory mask can be sealingly placed. The sealing face may more particularly be a smooth surface—for example, a smooth stainless-steel surface, a smooth plastic surface, a smooth glass surface or else a smooth ceramic surface—whose smoothness is preferably such that a suction cup pressed onto this surface would adhere on the surface for at least a minute. To provide the sealing face, the holder may, for example, be a three-dimensional body or have a three-dimensional body, which at least approximately has the shape of a human head or at least the shape of a human face. However, alternatively or additionally, the three-dimensional body may also be wholly or partly in shell-shaped design—in the form, for example, of a thick shell or else a curved sheet, with a curved surface of the shell, having at least approximately the shape and dimensions of human face. In general it is possible in this context, whether relating to the human head or to the curved shell, for fine contours such as nose, eye sockets or ears, for example, to be optionally omitted. The sealing face preferably has dimensions of at least 100 $cm^2$, more particularly of at least 200 $cm^2$. For example, the sealing face may have a dimension of 100 $cm^2$ to 600 $cm^2$. Other dimensions as well, however, are possible in principle. The sealing face may have, for example, a mean radius of curvature of 8 cm to 40 cm.

The term "sealing lip" as it is used here is likewise a broad term which is to be accorded its common and usual meaning as it is understood by the skilled person. The term is not restricted to a specific or adapted meaning. The term, without restriction, may refer in particular to an elongated element in the form of a projection, which is elastic in design and which is configured to form an elongated seal in interaction with a sealing face. For example, the sealing lip may be an elastic projection running round in a ring shape in the region of an edge of the respiratory mask, in which case the projection may be of single or else double or multiple design. In method step c), the respiratory mask is stretched over the holder in such a way that the sealing lip of the respiratory mask lies on the curved sealing face and preferably forms a seal against said face. For example, stretching may be accomplished by pressing the sealing lip of the respiratory mask against the sealing face—elastically, for example. Accordingly, "stretching" may be understood in particular as a pressing of the respiratory mask onto the sealing face.

An "interior" of the respiratory mask may be understood in particular as an intermediate space between the respiratory mask and the sealing face. The interior, correspondingly, may be delimited by the respiratory mask and the sealing face, and may be sealed off by the sealing lip.

In method step d), the holder with the respiratory mask is introduced into a precleaning chamber. The term "precleaning chamber" as it is used here is a broad term which is to be accorded its usual and common meaning as it is understood by the skilled person. The term may refer in particular to a cleaning chamber in which the at least one precleaning step is carried out. The term is not restricted to a specific or adapted meaning. The term, without restriction, may refer in particular to a space which is surrounded partly or completely by at least one wall or at least one housing, and in which cleaning, and more particularly the at least one precleaning step, in the sense of the above definition can take place. This precleaning chamber may be designed in principle as a closed or opened precleaning chamber or one which is to be opened. It is particularly preferred if the precleaning chamber is enclosed on all sides or at least in two dimensions by a housing, which may be of fully closed design but which in principle may also have one or more passages and/or openings. The precleaning chamber may be designed in particular as a rigid precleaning chamber, in other words as a precleaning chamber which during a cleaning procedure does not alter its position and/or orientation, but may in principle also be designed as a movable precleaning chamber, as a pivotable and/or rotatable precleaning chamber, for example, which during a cleaning procedure in a precleaning appliance alters its position and/or orientation, as a result, for example, of rotation, turning, a spinning procedure, a shaking procedure, or similar movements. Accordingly the precleaning chamber may be designed, for example, as a washing chamber of a washing machine, and the cleaning appliance may be designed as a washing machine, and/or the precleaning chamber may be designed as the drum of a washing machine, and the precleaning appliance in the form of a washing machine. For example, dishwashing machines and/or laundry washing machines of commercial type or for the household sector may be modified in accordance with the invention. In particular, however, the washing machine in question may be a modified washing machine of the kind typically utilized in the trade, more particularly a single-chamber washing machine with exactly one cleaning chamber, the fluid facility of which has two separate systems, namely a washing system and a separate rinsing system with a separate rinsing tank in which a rinsing liquid can be temperature-conditioned during the actual washing.

The introduction of the holder with the respiratory mask into the precleaning chamber may take place in a variety of ways. For example, there may be at least one receptacle provided in the precleaning chamber in which the holder can be fixed. Alternatively or additionally, the holder may also be introduced into the precleaning chamber by means of at least one basket, in which case, for example, the holder is releasable or connected fixedly to the basket. Examples are explained in more detail below.

In method step e), an outer side of the respiratory mask is exposed in the precleaning chamber to at least one precleaning fluid. The precleaning fluid in this context refers generally to a cleaning fluid which is configured for the purpose of the above-described precleaning. The precleaning fluid may more particularly be a fundamentally arbitrary liquid and/or gas, which may have a macroscopically and/or microscopically cleaning effect on the article for cleaning, more particularly the breathing apparatus and/or the respiratory mask. "Exposing" in this context refers generally to contacting, of whatever kind, of the article for cleaning with the precleaning fluid. This may take place, for example, in the form of direct exposure, as for example by spraying, dropping, jetting, or a combination of the stated and/or other direct types of exposure, in which the precleaning fluid arrives directly on the article for cleaning, such as the breathing apparatus and/or the respiratory mask, for example. This refinement of the exposing may take place in particular with a fixed precleaning chamber, in the case of a washing machine for dishwashing, for example. Alternatively or additionally, the exposing may also take place by the precleaning chamber being filled completely or partly with precleaning fluid, so that the precleaning fluid accommodated in the cleaning chamber comes into contact with the precleaning fluid at least in one position of the precleaning chamber. This refinement of the exposing may be utilized in particular where the precleaning chamber is designed as a movable precleaning chamber, in the form of a drum, for example. Combinations of the stated exposure types and/or other exposure types are also possible. Irrespective of whether the precleaning chamber is of rigid or moving design, the exposure to the cleaning fluid may take place in single operation, by the precleaning fluid acting only once on the article for cleaning, such as the breathing apparatus and/or the respiratory mask, for example. Alternatively or additionally, however, cleaning may also take place in a circulation mode, with precleaning fluid being applied multiply to the article for cleaning. Circulating modes and circulating circuits of this kind are known from, for example, conventional machines for the washing of dishware or laundry.

The proposed method may be advantageously developed and designed in a variety of ways. These refinements can also be realized in combination, as the skilled person will recognize.

The method may in particular be carried out such that before method step c), at least one respiratory gas-conducting element, more particularly at least one breathing regulator, is removed from the respiratory mask. The term "breathing regulator" as it is used here is likewise a broad term which is to be given its usual and common meaning as it is understood by the skilled person. The term is not restricted to a specific or adapted meaning. The term, without restriction, may refer in particular to an appliance which allows the respiration of a respiratory gas under pressure, including, where appropriate, underwater or in a toxic atmosphere. The appliance may in particular be configured to reduce respiratory gas from a respiratory-gas source, such as a compressed-gas bottle, for example, to an ambient pressure or desired inhalation pressure. The breathing regulator may comprise, for example, at least one respiration regulator. In order to remove the breathing regulator from the respiratory mask, a connection between these elements can be released, for example—a screw connection or a quick-fit connection, for example.

Before implementation of the method step d), an opening in which the breathing regulator is connected to the respiratory mask can be closed again, for example, automatically by a self-closing valve, and/or actively. In particular, after method step c) and before implementation of method step d), the respiratory gas-conducting element can be connected again to the respiratory mask.

The method may further be carried out by the holder with the respiratory mask stretched thereon being introduced, after method step c), into at least one transport box, and transported with the transport box to a precleaning appliance comprising the precleaning chamber, before method step d) is carried out there. During transport, in particular, the transport box may have been closed off in an airtight manner. By means of the transport box, for example, the breathing apparatus may be conveyed wholly or partly from a deployment location back to a cleaning center, for cleaning there. Additionally to the at least one respiratory mask, moreover, at least one personal protective equipment element assigned to the respiratory mask may be introduced into the transport box, more particularly at least one element selected from the group consisting of: a respiratory gas bottle; a carrying frame for the respiratory gas bottle; a pressurized-air breathing apparatus.

Other possible refinements relate to the holder. In particular, the holder may be specially shaped in whole or in part. For example, the holder may in whole or in part have a shape selected from the group consisting of: a head shape; a face shape; a sphere shape; a sphere segment shape; a sphere shell shape, a freeform surface shell. For example, the molder may correspond to or be modeled on, wholly or partly, a so-called Sheffield head, of the kind used in numerous tests in the area of respiratory protective equipment. Alternatively or additionally, the holder may also correspond wholly or partly to the facial area which is specified in DIN EN 136:1998-04, Respiratory protective devices—Full face masks—Requirements, testing and marking, on page 19 of EN 136. The dimensions specified there may also be used, for example, for the holder or for the sealing face of the holder. However, other configurations are also possible, examples being rotationally ellipsoidal shapes or sphere shapes or sphere segment shapes.

The sealing face may more particularly be a continuous sealing face which is configured to close off the interior completely, together with the sealing lip. Accordingly, for example, the sealing face may be free from intermediate spaces, grooves, interruptions or similar discontinuities that penetrate the seal through the sealing lip.

The holder may further have at least one fastening section for fastening at least one fixing of the respiratory mask on the holder. A "fastening section" in this case may refer generally to a part of the holder which may be designed in one piece with the sealing face or else separately from the sealing face, and on which the fixing of the respiratory mask may be fastened. For example, this fastening section may be a head back of a headform or else, for example, a separate extension, a rod or a similar means which may be arranged on a reverse of the holder, lying opposite the sealing face. The fastening section may more particularly be selected from the group consisting of: a head back of an artificial head of the holder; a holder extension lying opposite the curved sealing face. A "fixing" may be understood in particular to be an arbitrary element or device which is configured to fix the respiratory mask on a head of a user in such a way that the respiratory mask is pressed fixedly by the sealing lip onto the face. The fixing may more particularly have at least one element selected from the group consisting of: a belt; a fixing strap; webbing.

As stated above, in method step e) the at least one outer side of the respiratory mask is exposed to at least one precleaning fluid. This exposure in step e) may be accomplished in particular in a manner such that the interior of the respiratory mask remains free from cleaning fluid. The "interior" of the respiratory mask here may refer generally to a space which is formed between the respiratory mask and the curved sealing face when the respiratory mask has been stretched onto the holders. This interior is preferably closed off completely by the respiratory mask, the curved sealing face, and the sealing lip. The exposure in step e) is therefore preferably such that no precleaning fluid enters the interior. Accordingly, for example, in the precleaning step, the only surfaces of the respiratory mask that are cleaned are those which are actually also subject to the harmful environment, smoke gases for example, in use, but not, conversely, surfaces which come into contact only with the skin of the user and, for example, perspiration. These surfaces may be cleaned subsequently in at least one primary cleaning step, as will be described in more detail below. In this way, for example, it is possible to prevent the entrainment of toxic impurities from the outer side of the respiratory mask to an inner side during the at least one precleaning step.

Hence the method step e) of the precleaning step may in particular be carried out wholly or partly in the circulation mode of the at least one precleaning fluid, without any risk during circulation of toxic substances being entrained from the outer side of the respiratory mask to the inner side, with the consequence that in the next deployment, where appropriate, traces of these toxic substances would then still be present on the inner side and therefore, for example, would be present in skin contact. Another advantage of the method may in particular be that the entrainment of hazardous and unwanted substances from the precleaning step/the precleaning chamber into the ultimate or primary cleaning step/ultimate or primary cleaning chamber is prevented. Such entrainment would in particular be possible if contaminated precleaning fluid were to reach the inner side of the respiratory mask. The inner side of a respiratory mask usually has cavities and subvolumes which do not empty automatically.

In circulation mode, for example, the precleaning fluid or a portion of the precleaning fluid, a primary precleaning fluid for example, may be used for a plurality of successive cycles of a plurality of respiratory masks—for example, for at least 3 cycles, more particularly for at least 5 cycles, or even more cycles.

Method step e) may contain one single step or else a plurality of steps. Hence, in particular, the exposure to the at least one precleaning fluid may take place in a plurality of stages. It is possible first, for example, in a circulation mode, for a washing operation to take place, followed by at least one rinse mode, in which residues of the precleaning fluid used in the washing process are rinsed off, using—for example—fresh water with or without additives.

Hence, generally, the method may be carried out such that the at least one precleaning fluid comprises at least one primary precleaning fluid and at least one rinsing precleaning fluid. Method step e) may comprise at least one primary precleaning step and at least one rinsing precleaning step. In the primary precleaning step, the outer side of the respiratory mask may be exposed to the primary precleaning fluid, and in the rinsing precleaning step, the outer side of the respiratory mask may be exposed to the rinsing precleaning fluid. In this case, in particular, the primary precleaning step may be carried out in circulation mode, whereas the rinsing precleaning step is not carried out in circulation mode, thus being carried out such that the outer side of the respiratory mask is exposed only once to the rinsing precleaning fluid. The rinsing precleaning fluid may more particularly comprise fresh water or a heated aqueous rinsing liquid admixed, for example, with rinse-aid additives. During the primary precleaning step, the rinsing precleaning fluid may be heated in a rinsing tank designed separately from the precleaning chamber. An alternative possibility, however, is a changeover of the liquids, so that, for example, the primary precleaning fluid is removed before the rinsing precleaning step is carried out, and the rinsing precleaning fluid is prepared in the same tank as was, before, the primary precleaning fluid. A further alternative possibility is also the provision of a rinsing precleaning fluid which has already been externally prepared—hot water, for example.

Hence it is possible generally for the precleaning step to include at least one substep in which the cleaned breathing apparatus is treated with a clear-rinse solution. In the case of cleaning appliances with a two-circuit system, the rinsing precleaning fluid may be provided, for example, from a second tank, more particularly a boiler. In principle, however, the rinsing precleaning fluid could also be generated in a single-circuit machine, for example, by completely emptying the tank and filling it anew, with fresh water, for the clear-rinse step.

In general, as a result of this multistage configuration of method step e), it is possible to ensure at least largely that residues of the precleaning fluid, with toxins possibly contained therein, are rinsed from the breathing apparatus.

The precleaning chamber may in particular have at least one fixing device for the direct or indirect accommodation of the holder. This may be, for example, a fixing on which the holder is mounted directly, in which case one or more holders, as for example 2, 3, 4 or more holders simultaneously, may be introduced into the precleaning chamber and may be fixed there, preferably releasably, by means, for example, of a fixing device in the form of a thread, a clamp or another positively locking or nonpositively locking connection. Alternatively or additionally, there may also be an indirect introduction. Thus, for example, the precleaning chamber may have at least one rail, into which at least one cleaning basket can be inserted. This cleaning basket may accommodate, or be able to accommodate, one or more holders, fixedly or releasably. Additionally, the cleaning chamber may also accommodate other constituent parts of the breathing apparatus and/or of the personal protective equipment. For example, one or more small-parts baskets may be contained in the holder, in order, for example, to accommodate relatively small elements of the personal protective equipment and/or of the breathing apparatus, in a manner, for example, in which they cannot be lost. The at least one holder with the at least one respiratory mask may generally, therefore, be introduced into the precleaning chamber in at least one cleaning basket. In this case a single holder may be accommodated in the cleaning basket, or a plurality of holders with a plurality of respiratory masks may be accommodated in the cleaning basket. In general, therefore, the at least one holder may for example be selected from the group consisting of: a holder fixedly connected to the cleaning basket; a holder releasably connectable to the cleaning basket and joined to the cleaning basket preferably before method step d), together with the respiratory mask stretched thereon. Other embodiments are also possible in principle.

As stated above, the proposed method for cleaning the at least one breathing apparatus comprises at least one precleaning step. The purpose of this precleaning step may be in particular, as stated above, to remove toxic impurities, such as residues of smoke gases or other toxins, for example, at least largely from an outer side of the at least one respiratory mask. The proposed method may also, additionally, comprise at least one primary cleaning step, in which, in that case, at least remaining constituent parts of the respiratory mask as well, more particularly an inner side of the respiratory mask, can be cleaned, to remove perspiration, for example. Because the primary cleaning step is carried out preferably after the precleaning step, it is possible through this separation of the cleaning steps to ensure, preferably, that entrainment of toxic impurities to the inner side of the respiratory mask can at least largely be prevented.

It is proposed accordingly that the method additionally has at least one primary cleaning step carried out after the precleaning step. The primary cleaning step comprises the following substeps, preferably in the order stated. Any other order is also possible in principle. In particular, a wholly or partly synchronous performance of the substeps is also possible. Moreover, individual, two or more, or all of these steps, in particular all substeps, of the primary cleaning step may be implemented repeatedly, in particular more than once. The primary cleaning step may also comprise further substeps in addition to those stated. The substeps of the primary cleaning step are as follows:

i) releasing the respiratory mask from the holder;
ii) introducing the respiratory mask into a primary cleaning chamber; and
iii) exposing the respiratory mask, including an inner side of the respiratory mask that faces the interior, to at least one primary cleaning fluid.

The term "primary cleaning step" as it is used here is a broad term which is to be accorded its common and usual meaning as it is understood by the skilled person. The term may refer in particular to a substep of a cleaning method. In particular, the primary cleaning step may be designed to expose the at least one respiratory mask and also, where appropriate, further parts of the breathing apparatus, and also, optionally, other parts of the personal protective equipment as well, to cleaning fluid, and to clean them by means of the cleaning fluid, preferably from two or more sides or even from all sides. In particular, it is also possible in the primary cleaning step, as will be described in more detail below, to remove perspiration or other impurities from the inner side of the respiratory mask. The primary cleaning step is preferably designed completely separately from the precleaning step, and preferably takes place after that step, and preferably also takes place with spatial separation from that step.

The releasing of the respiratory mask from the holder may be accomplished, for example, by raising the sealing lip of the respiratory mask from the sealing face. Moreover, at least one fixing may be released from the holder—for example, a fixing strap or some other kind of fixing.

The term "primary cleaning chamber" as it is used here is a broad term which is to be accorded its usual and common meaning as it is understood by the skilled person. The term may relate in particular to a cleaning chamber in which the at least one primary cleaning step is carried out. The term is not restricted to a specific or adapted meaning. The term, without restriction, may refer in particular to a space which is surrounded partly or completely by at least one wall or at least one housing, and in which cleaning and, in particular, the at least one primary cleaning step can take place in the sense of the definition above. This primary cleaning chamber may be designed in principle as a closed or opened primary cleaning chamber or as a primary cleaning chamber to be opened. It is particular preferred if the primary cleaning chamber is surrounded on all sides or at least in two dimensions by a housing, which may be fully closed in design, but which in principle may also have one or more passages and/or openings. The primary cleaning chamber may be designed in particular as a rigid primary cleaning chamber, hence as a primary cleaning chamber which does not alter its position and/or orientation during a cleaning procedure, but may in principle also be designed as a movable primary cleaning chamber, as a pivotable and/or rotatable primary cleaning chamber, for example, which alters its position and/or orientation during a cleaning procedure in a primary cleaning appliance, by means of a rotation, a turning, a spinning operation, a shaking operation or similar movements, for example. Accordingly, the primary cleaning chamber may be designed, for example, as the washing chamber of a washing machine, and the cleaning appliance as a washing machine, and/or the primary cleaning chamber may be designed as the drum of a washing machine, and the primary cleaning appliance in the form of a washing machine. For example, washing machines for dishwashing and/or laundering of commercial type or for the household sector, may be modified in accordance with the invention. In particular, however, the washing machine in question may be a modified washing machine of the kind typically utilized in the trade, more particularly a single-chamber washing machine with exactly one cleaning chamber, the fluid facility of which has two separate systems, namely a washing system and a separate rinsing system with a separate rinsing tank in which a rinsing liquid can be temperature-conditioned during the actual washing.

The primary cleaning fluid in this context refers generally to a cleaning fluid which is configured for the purpose of the above-described primary cleaning. The primary cleaning fluid may more particularly be a fundamentally arbitrary liquid and/or gas, which may have a macroscopically and/or microscopically cleaning effect on the article for cleaning, more particularly the breathing apparatus and/or the respiratory mask. "Exposing" in this context refers generally to contacting, of whatever kind, of the article for cleaning with the primary cleaning fluid. This may take place, for example, in the form of direct exposure, as for example by spraying, dropping, jetting, or a combination of the stated and/or other direct types of exposure, in which the primary cleaning fluid arrives directly on the article for cleaning, such as the breathing apparatus and/or the respiratory mask, for example. This refinement of the exposing may take place in particular with a fixed primary cleaning chamber, in the case of a washing machine for dishwashing, for example. Alternatively or additionally, the exposing may also take place by the primary cleaning chamber being filled completely or partly with primary cleaning fluid, so that the primary cleaning fluid accommodated in the primary cleaning chamber comes into contact with the article for cleaning at least in one position of the primary cleaning chamber. This refinement of the exposing may be utilized in particular where the primary cleaning chamber is designed as a movable primary cleaning chamber, in the form of a drum, for example. Combinations of the stated exposure types and/or other exposure types are also possible. Irrespective of whether the primary cleaning chamber is of rigid or moving design, the exposure to the cleaning fluid may take place in single operation, by the primary cleaning fluid acting only once on the article for cleaning, such as the breathing apparatus and/or the respiratory mask, for example. Alternatively or additionally, however, cleaning may also take place in a circulation mode, with primary cleaning fluid being applied multiply to the article for cleaning. Circulating modes and circulating circuits of this kind are known from, for example, conventional machines for the washing of dishware or laundry.

The term "inner side" as it is used here is a broad term which is to be accorded its usual and common meaning as it is understood by the skilled person. The term is not restricted to a specific or adapted meaning. The term, without restriction, may refer in particular to at least one surface of the respiratory mask which is facing the face of the user in use. This inner side may be sealed off from the surrounding environment by the sealing lip during use. As stated above, the interior, in the case of the respiratory mask stretched onto the holder, is formed between the respiratory mask and the sealing face, or, in use by a user, between the respiratory mask and the face of a user. Accordingly, in use, the inner side faces the face of the user, whereas in the stretched-on state, it faces the sealing face of the holder. In both cases, then, the inner side is a side which is not exposed to the surrounding environment—the smoke gases, for example—owing preferably to the sealing effect of the sealing lip.

The holder with the respiratory mask may be introduced into the primary cleaning chamber in a variety of ways. This introduction into the primary cleaning chamber is accomplished preferably such that the inner side of the respiratory mask facing the interior, as defined above, is accessible. For example, the respiratory mask may be placed loose into a cleaning basket and introduced with said basket into the primary cleaning chamber. The cleaning basket may be identical to the cleaning basket used for the precleaning step, or else may have a different design from that basket. Besides the respiratory mask, further elements of the breathing apparatus may be accommodated in the cleaning basket. For example, the cleaning basket may also have in turn at least one small-parts basket, in which relatively small parts of the breathing apparatus and/or of the personal protective equipment can be accommodated, in a manner such as to be unable to be lost, for example.

The at least one primary cleaning step may be carried out in particular as described in WO 2011/144518 A1. In particular, the cleaning appliance described therein may be used for the primary cleaning, and/or the primary cleaning chamber may be provided by the cleaning appliance described therein.

In particular, in the primary cleaning step, the at least one respiratory mask may be cleaned jointly with at least one gas-conducting element of the breathing apparatus. In this case, in particular, the exposing of the respiratory mask in method step iii) to the at least one primary cleaning fluid may take place in such a way that the gas-conducting element is exposed to a pressurized gas, so that the primary cleaning fluid does not reach the inside of the gas-conducting element. Thus, for example, the primary cleaning chamber may be a constituent part of a primary cleaning appliance which in addition, for example, to a fluid facility for exposing the breathing apparatus to the at least one primary cleaning fluid, also referred to as exposure appliance, may additionally have at least one pressure exposure appliance with at least one pressure connection. The pressure connection may be connected or connectable to the at least one gas-conducting element of the breathing apparatus, in which case the pressure exposure appliance is configured in order to expose the gas-conducting element to pressurized gas, in particular during the exposure of the respiratory mask to the primary cleaning fluid. For further possible refinements of the primary cleaning appliance, reference may be made to the cleaning appliance described in WO 2011/144518 A1. Other refinements, however, are also possible in principle.

In a further aspect of the present invention, an appliance is proposed for cleaning at least one breathing apparatus. The appliance may in particular be configured to implement the above-proposed method in one of the above-described refinements or else in one of the refinements described in more detail below. Accordingly, for possible refinements of the appliance and also for definitions, reference may be made to the above description of the method.

The breathing apparatus again comprises at least one respiratory mask. The appliance has at least one holder, and the holder has at least one curved sealing face. The respiratory mask can be stretched over the holder such that a sealing lip of the respiratory mask lies on the curved sealing face and closes off an interior of the respiratory mask. As stated above, the holder may in particular have a shape selected from the group consisting of: a head shape; a face shape; a sphere shape; a sphere segment shape; a sphere shell shape; a freeform surface shell. The sealing face may in particular be a continuous sealing face which is configured to seal off the sealing lip completely and to close off completely the interior bordered by the sealing lip. The holder may additionally have at least one fastening section for fastening at least one fixing of the respiratory mask on the holder, more particularly at least one fixing selected from the group consisting of: a belt; a fixing strap; webbing. The fastening section may be selected in particular from the group consisting of: the back of an artificial head of the holder; an extension of the holder that is opposite the curved sealing face. The cleaning appliance may further comprise at least one cleaning basket. The holder may be selected more particularly from the group consisting of: a holder fixedly connected to the cleaning basket; a holder releasably connectable to the cleaning basket, which is connected to the cleaning basket preferably before method step d), together with the respiratory mask stretched thereon. For further possible refinements of the holder and/or of the sealing face, reference may be made to the description above.

In a further aspect, a precleaning appliance is proposed for precleaning personal protective equipment. A precleaning appliance here may be understood generally to be an appliance which has at least one precleaning chamber and which is preferably configured to carry out the precleaning step as defined above, with the precleaning appliance taking part more particularly in method steps d) and e).

The precleaning appliance comprises at least one precleaning chamber as defined above. Additionally, the precleaning appliance comprises the proposed at least one appliance for cleaning at least one breathing apparatus in accordance with one or more of the refinements described above, having the at least one holder described. The appliance can be introduced into the precleaning chamber with at least one respiratory mask stretched over the at least one holder. The precleaning appliance additionally has at least one exposure appliance for exposing an outer side of the respiratory mask to at least one precleaning fluid in the precleaning chamber.

The term "exposure appliance", also referred to as "fluid facility", as it is used here, is a broad term which is to be accorded its usual and common meaning as it is understood by the skilled person. The term is not restricted to a specific or adapted meaning. The term, without restriction, may refer in particular to an appliance by means of which the article for cleaning that is accommodated within the cleaning chamber, in this case the precleaning chamber, such as the breathing apparatus, for example, can be exposed in any desired way, directly or indirectly, to the cleaning fluid, in this case, more particularly, the precleaning fluid. This exposing is accomplished, for example, in the form of direct exposing, by spraying, dropping, jetting, or a combination of the stated and/or other direct types of exposure, in which cleaning fluid emerging from the fluid facility impinges—in particular directly—on the article for cleaning. The exposure appliance may in particular have at least one nozzle. The precleaning appliance may be designed in particular as a programmable machine, and may have a controller configured to implement at least one cleaning program with the at least one precleaning step. In particular, the precleaning appliance may be designed in the form of a washing machine whose cleaning chamber, which here can function as a precleaning chamber, accommodates the described appliance with the holder, and which has, for example, a controller for implementing the precleaning step. The washing machine may be designed in particular as a commercial dishwashing machine, with a separate tank for rinsing liquid. An alternative possibility, however, is to use a single-circuit dishwashing machine as precleaning appliance, possessing only one fluid tank, from which the respiratory masks are cleaned with precleaning fluid, in circulation mode, for example.

In a further aspect, a cleaning system is proposed for cleaning at least one breathing apparatus with at least one respiratory mask and also, optionally, further constituent parts of personal protective equipment. The term "cleaning system" as it is used here is a broad term which is to be accorded its usual and common meaning as it is understood by the skilled person. The term is not restricted to a specific or adapted meaning. The term, without restriction, may refer in particular to an appliance which is composed of a plurality of components and which serves the purpose of cleaning. In particular, the cleaning system may have two or more cleaning appliances, in each of which there is at least one cleaning chamber provided, and in each of which the article for cleaning can be exposed to cleaning fluid. The cleaning system may in particular be configured to carry out the above-described method in one or more of the refinements described.

The cleaning system comprises at least one precleaning appliance in accordance with one or more of the refinements described above or described in more detail below. The cleaning system further comprises at least one primary cleaning appliance, more particularly a primary cleaning appliance embodied separately from the precleaning appliance. The primary cleaning appliance for its part comprises at least one primary cleaning chamber, more particularly a primary cleaning chamber separate from the precleaning chamber. The respiratory mask, after precleaning in the precleaning appliance, released from the holder, can be introduced into the primary cleaning chamber. The primary cleaning appliance additionally has at least one exposure appliance for exposing the respiratory mask, including an inner side of the respiratory mask facing the interior, to at least one primary cleaning fluid. A primary cleaning appliance can be understood generally to be a cleaning appliance in which the at least one primary cleaning step can be carried out. For possible refinements of the at least one primary cleaning appliance, reference may be made for example, as already stated above, to the cleaning appliance described in WO 2011/144518 A1. Other refinements as well, however, are possible in principle.

The cleaning system may in particular have two separate washing machines, with a first washing machine serving as precleaning appliance, in which the at least one precleaning step can take place, with a respiratory mask stretched over the holder. A second washing machine may serve as primary cleaning appliance, in which the primary cleaning step takes place. In that case, for example, there may be at least one pressure exposure appliance with at least one pressure connection provided in the primary cleaning appliance, as stated above. The pressure connection may be connected or connectable to the at least one gas-conducting element of the breathing apparatus, with the pressure exposure appliance configured to expose the gas-conducting element to pressurized gas, in particular during the exposing of the respiratory mask to the primary cleaning fluid. The primary cleaning appliance may more particularly be designed as a commercial dishwashing machine, having for example at least two separate tanks, in which case rinsing fluid can be prepared in a rinsing tank, separately from a washing tank.

As compared with known methods and appliances for the cleaning of breathing apparatuses, the proposed method and the proposed appliances have numerous advantages. Thus, overall, components of the personal protective equipment (PPE) after deployment can be cleaned and optionally also disinfected, as part, for example, of the primary cleaning step or subsequent to the primary cleaning step. Generally speaking, the cleaning can be divided into at least two steps, namely at least one precleaning step and at least one primary cleaning step. In the precleaning step, coarse soiling may be removed, in particular on the outside of the individual components such as the respiratory masks. The respiratory masks in particular can then be given a final cleaning on the inner side as well in a second step, the primary cleaning step, and subsequently disinfected as an option.

The objective of the precleaning step may in particular be to wash off fire residues containing substances injurious to health—soot, for example. Instead of simply hanging up the respiratory masks freely in the precleaning chamber, without closing off the mask interior, it is possible in accordance with the invention to close off the interior by the stretching of the at least one respiratory mask over the at least one holder. This may take place, for example, in the course of the following operating steps, which provide an illustrative description of the handling of the components of the personal protective equipment of a fire department operative up to transfer into a disinfection washing machine:

1. The fire department operative ends or interrupts his deployment, releases the breathing regulator from the respiratory mask; in practice, the respiratory mask can still be left on the face for a short time, for acclimatization.
2. The fire department operative pulls the respiratory mask from his face in such a way that, with his gloves, he makes contact only with the externally contaminated surfaces.
3. The respiratory mask is placed into a transport box, in which the respiratory masks, for example, are already pulled onto the holders—onto heads, for example. The breathing regulators remain on the pressurized-air breathing apparatus, as do the pressurized-gas bottles. These gas-conducting elements are likewise packed into transport boxes, which are given an airtight closure for transport.
4. In the so-called black area of the fire department, the dirty operating area, the transport boxes, optionally using personal protective equipment such as mouth protection and gloves, for example, are opened and in each case, for example, four pressurized-air breathing apparatuses, including breathing regulators and pressurized-gas bottles, as well as a corresponding number of respiratory masks, are withdrawn from the transport box and placed onto the holders in the precleaning chamber of the precleaning appliance.
5. The breathing regulators are connected to the respiratory masks again, so that both the breathing regulators and the respiratory masks are closed toward the outside, because:
   a. the exhalation valve of the respiratory mask is typically protected physically by a respiratory mask cover grid and, in accordance with its function, allows media only from the inside of the mask outward;
   b. the breathing regulator is typically still attached on one side to a medium-pressure line of the pressurized-air breathing apparatus, and on the other side in that case is connected to the respiratory mask, and is therefore closed in both directions and protected against direct liquid ingress;
   c. the pressurized-air breathing apparatus is sealed using, for example, a manufacturer sealing set, in which case, for example, an alarm whistle is also closed by one or more stoppers.
6. After the precleaning step in the precleaning chamber/precleaning appliance, the breathing regulators and the respiratory masks are conveyed to the primary cleaning step and optionally, for disinfection, into the primary cleaning appliance—for example into a disinfection washing machine.
7. The pressurized-air breathing apparatuses can be subsequently hung up to dry and/or placed into a drying cabinet, and pressurized-gas bottles can be dried manually or else stored for drying.
8. The holders, the "heads" as for example, on which the respiratory masks were stretched, and also, optionally, the transport boxes, are cleaned in the precleaning appliance or otherwise and are thereafter dried, before they are conveyed back together onto the vehicles, ready for the next deployment.

As the skilled person will recognize, this illustrative description of a method represents merely one possible exemplary embodiment, and the skilled person will recognize corresponding variants and implement them as and when necessary.

The proposed method permits efficient precleaning of respiratory masks, encompassing the removal, in particular by washing, of fire residues, for example, such as soot and/or other substances hazardous to health, for example. At the same time, however, the proposed method efficiently prevents the substances washed off from the outer side of the respiratory mask from contaminating the inner side of the mask, by being transported into the mask interior as well in the washing process, as a result, for example, of the circulation of the cleaning fluid—the wash liquor, for example. The proposed method therefore effectively prevents the mask interior becoming unnecessarily contaminated by the fire residues, and so removes the need for this contamination on the inner side to be eliminated subsequently. Moreover, the proposed method effectively prevents the primary cleaning appliance, which generally may be designed, for example, as a disinfecting washing machine, from becoming contaminated because of entrained fluid remnants containing unwanted substances such as fire residues, for example.

In the precleaning appliance, for the processing of, for example, up to four complete sets of respiratory protective equipment, comprising the respiratory mask, the breathing regulator, the pressurized-air breathing apparatus, and the pressurized-gas bottle, the respiratory masks can be placed, still in completely mounted form, on the holder, as for example on the holder in the form of a head or a holding plate, so that the sealing lips of the respiratory masks, with the sealing faces of the holders, completely close off the interior of the respiratory masks. The respiratory masks may be fixed, for example, by tightening the webbing or strapping of the respiratory masks on the head itself or on a corresponding counterpart on the holder, the holding plate, for example. An open hose end of the breathing regulator may be closed and/or sealed off before the cleaning operation, for example, as described above under 5. Accordingly, the penetration of fire residues into the interior of the respiratory mask during the precleaning step can preferably be effectively prevented, so that preferably no toxic substances are entrained into the subsequent primary cleaning step.

In summary, without restriction of further possible refinements, the following embodiments are proposed:

Embodiment 1: a method for cleaning at least one breathing apparatus comprising at least one respiratory mask, where the method comprises at least one precleaning step, the precleaning step comprising the following substeps:

a) providing the breathing apparatus in an externally contaminated state;
b) providing at least one holder for the respiratory mask, the holder having at least one curved sealing face;
c) stretching the respiratory mask onto the holder such that at least one sealing lip of the respiratory mask lies on the curved sealing face and closes off an interior of the respiratory mask;
d) introducing the holder with the respiratory mask into a precleaning chamber; and
e) exposing an outer side of the respiratory mask in the precleaning chamber to at least one precleaning fluid.

Embodiment 2: a method according to the preceding embodiment, wherein before method step c) at least one respiratory gas-conducting element, more particularly a breathing regulator, is removed from the respiratory mask.

Embodiment 3: a method according to the preceding embodiment, wherein after method step c) and before implementation of method step d), the respiratory gas-conducting element is connected again to the respiratory mask.

Embodiment 4: a method according to any one of the preceding embodiments, wherein the holder with the respiratory mask stretched thereon, after method step c), is introduced into at least one transport box and is transported with the transport box to a precleaning appliance comprising the precleaning chamber, before method step d) is carried out there.

Embodiment 5: a method according to the preceding embodiment, wherein the transport box is closed off in an airtight manner during transport.

Embodiment 6: a method according to any one of the two preceding embodiments, wherein, additionally to the respiratory mask, at least one element of personal protective equipment assigned to the respiratory mask is additionally introduced into the transport box, more particularly at least one element selected from the group consisting of: a respiratory-gas bottle; a carrying frame for the respiratory-gas bottle; a pressurized-air breathing apparatus.

Embodiment 7: a method according to any one of the preceding embodiments, wherein the holder has a shape selected from the group consisting of: a head shape; a face shape; a sphere shape; a sphere segment shape; a sphere shell shape; a freeform surface shell.

Embodiment 8: a method according to any one of the preceding embodiments, wherein the sealing face is a continuous sealing face which is configured to close off the interior completely, together with the sealing lip.

Embodiment 9: a method according to any one of the preceding embodiments, wherein the holder additionally has at least one fastening section for fastening at least one fixing of the respiratory mask on the holder, more particularly at least one fixing selected from the group consisting of: a belt; a fixing strap; webbing.

Embodiment 10: a method according to the preceding embodiment, wherein the fastening section is selected from the group consisting of: the back of an artificial head of the holder; a holder extension opposite the curved sealing face.

Embodiment 11: a method according to any one of the preceding embodiments, wherein the exposing in step e) takes place in such a way that the interior of the respiratory mask remains free from cleaning fluid.

Embodiment 12: a method according to any one of the preceding embodiments, wherein method step e) is carried out at least partly in the circulation mode of the precleaning fluid.

Embodiment 13: a method according to the preceding embodiment, wherein the precleaning fluid is used at least partially for a plurality of successive cycles of a plurality of respiratory masks.

Embodiment 14: a method according to any one of the preceding embodiments, wherein the at least one precleaning fluid comprises at least one primary precleaning fluid and at least one rinsing precleaning fluid, where method step e) comprises at least one primary precleaning step and at least one rinsing precleaning step, where in the primary precleaning step the outer side of the respiratory mask is exposed to the primary precleaning fluid, and where in the rinsing precleaning step the outer side of the respiratory mask is exposed to the rinsing precleaning fluid.

Embodiment 15: a method according to the preceding embodiment, wherein the primary precleaning step is carried out in circulation mode and wherein the rinsing precleaning step is not carried out in circulation mode.

Embodiment 16: a method according to any one of the two preceding embodiments, wherein the rinsing precleaning fluid comprises fresh water.

Embodiment 17: a method according to any one of the three preceding embodiments, wherein during the primary precleaning step, the rinsing precleaning fluid is heated in a rinsing tank designed separately from the precleaning chamber.

Embodiment 18: a method according to any one of the preceding embodiments, wherein the precleaning chamber has at least one fixing appliance for the direct or indirect accommodation of the holder.

Embodiment 19: a method according to any one of the preceding embodiments, wherein the holder with the respiratory mask is introduced into the precleaning chamber in a cleaning basket.

Embodiment 20: a method according to the preceding embodiment, wherein a plurality of holders with a plurality of respiratory masks are accommodated in the cleaning basket.

Embodiment 21: a method according to any one of the two preceding embodiments, wherein the holder is selected from the group consisting of: a holder fixedly connected to the cleaning basket; a holder releasably connectable to the cleaning basket and connected before method step d), together with the respiratory mask stretched thereon, to the cleaning basket.

Embodiment 22: a method according to any one of the preceding embodiments, further comprising at least one primary cleaning step, which is carried out after the precleaning step and comprises the following substeps:

i) releasing the respiratory mask from the holder;

ii) introducing the respiratory mask into a primary cleaning chamber; and iii) exposing the respiratory mask, including an inner side of the respiratory mask that faces the interior, to at least one primary cleaning fluid.

Embodiment 23: a method according to the preceding embodiment, wherein the respiratory mask, in the primary cleaning step, is cleaned jointly with at least one gas-conducting element of the breathing apparatus, where in method step iii) the gas-conducting element is exposed to a pressurized gas, more particularly compressed air, so that the primary cleaning fluid does not reach the inside of the gas-conducting element.

Embodiment 24: an appliance for cleaning at least one breathing apparatus, more particularly by means of the method according to any one of the preceding embodiments, wherein the breathing apparatus comprises at least one respiratory mask, and the appliance having at least one holder, where the holder has at least one curved sealing face, the respiratory mask being stretchable onto the holder in such a way that a sealing lip of the respiratory mask lies on the curved sealing face and closes off an interior of the respiratory mask.

Embodiment 25: an appliance according to the preceding embodiment, wherein the holder has a shape selected from the group consisting of: a head shape; a face shape; a sphere shape; a sphere segment shape; a sphere shell shape; a freeform surface shell.

Embodiment 26: an appliance according to any one of the two preceding embodiments, wherein the sealing face is a continuous sealing face which is configured to close off the interior completely, together with the sealing lip.

Embodiment 27: an appliance according to any one of the preceding embodiments relating to an appliance, wherein the holder additionally has at least one fastening section for fastening at least one fixing of the respiratory mask on the holder, more particularly at least one fixing selected from the group consisting of: a belt; a fixing strap; webbing.

Embodiment 28: an appliance according to the preceding embodiment, wherein the fastening section is selected from the group consisting of: the back of an artificial head of the holder; a holder extension opposite the curved sealing face.

Embodiment 29: an appliance according to any one of the preceding embodiments relating to an appliance, further comprising at least one cleaning basket, where the holder is selected from the group consisting of: a holder fixedly connected to the cleaning basket; a holder releasably connectable to the cleaning basket.

Embodiment 30: a precleaning appliance for precleaning personal protective equipment, comprising at least one precleaning chamber, further comprising at least one appliance according to any one of the preceding embodiments relating to an appliance, wherein the appliance with at least one respiratory mask stretched onto the at least one holder can be introduced into the precleaning chamber, the precleaning appliance additionally having at least one exposing appliance for exposing an outer side of the respiratory mask to at least one precleaning fluid in the precleaning chamber.

Embodiment 31: a cleaning system for cleaning at least one breathing apparatus, more particularly by means of the method according to any one of the preceding embodiments, comprising at least one precleaning appliance according to the preceding embodiment, further comprising at least one primary cleaning appliance, more particularly a primary cleaning appliance designed separately from the precleaning appliance, wherein the primary cleaning appliance has at least one primary cleaning chamber, more particularly a primary cleaning chamber separate from the precleaning chamber, where at least one respiratory mask of the breathing apparatus can be introduced, after precleaning in the precleaning appliance, released from the holder, into the primary cleaning chamber, the primary cleaning appliance additionally having at least one exposing appliance for exposing the respiratory mask, including an inner side of the respiratory mask that faces the interior, to at least one primary cleaning fluid.

BRIEF DESCRIPTION OF THE FIGURES

Further details and features will emerge from the following description of exemplary embodiments, especially in conjunction with the dependent claims. Here, the respective features may be actualized on their own or collectively in combination with one another. The invention is not restricted to the exemplary embodiments. The exemplary embodiments are represented schematically in the figures. Identical reference numerals in the individual figures denote identical or functionally identical elements or elements which correspond to one another in terms of their functions.

Specifically.

DESCRIPTION OF THE EXEMPLARY EMBODIMENTS

Figure 1:
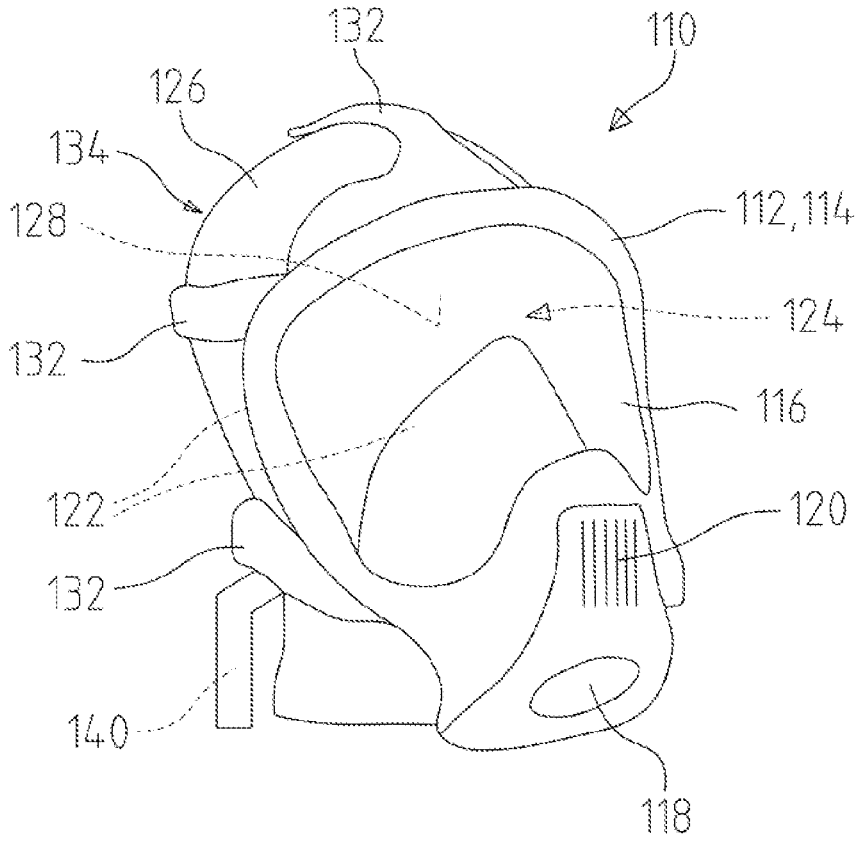
FIGS. 1 and 2 show various exemplary embodiments of an appliance 110 for cleaning at least one breathing apparatus.
Figure 2:
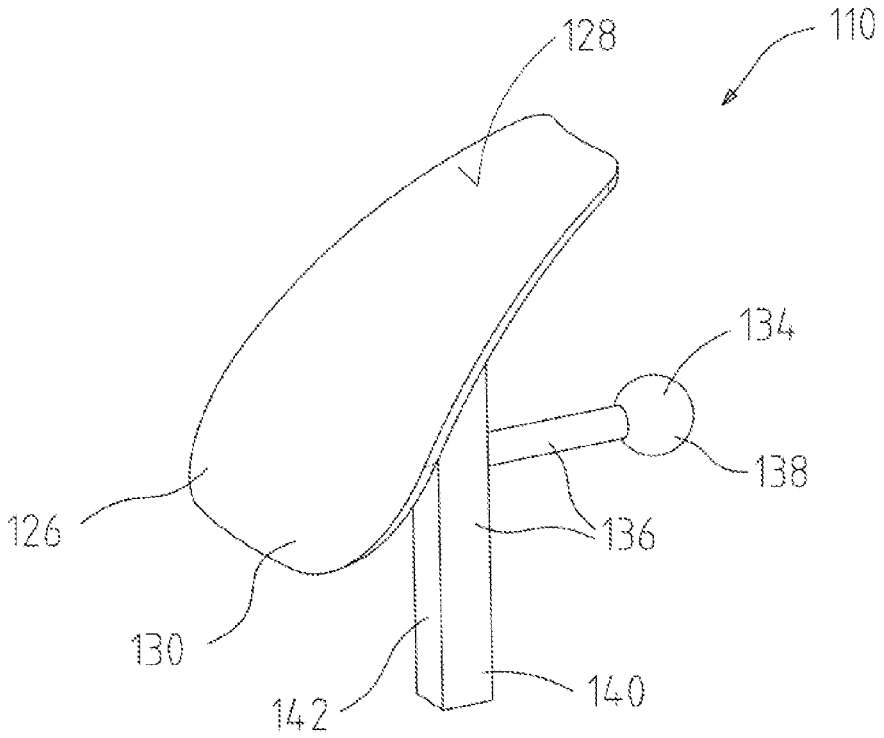

FIGS. 1 and 2 show various exemplary embodiments of an appliance 110 for cleaning at least one breathing apparatus 112. The breathing apparatus 112 comprises a respiratory mask 114, more particularly a respiratory protection mask, which is represented illustratively in FIG. 1. This respiratory mask 114 may have, for example, a viewing window 116, a port 118 for the connection of a respiratory regulator or breathing regulator, and also a self-closing exhalation valve 120. The respiratory mask 114 further comprises at least one sealing lip 122 for sealing off an interior 124 of the respiratory mask 114 with respect to a surrounding environment. A side of the respiratory mask 114 that faces the interior 124 is also referred to hereinafter as the inner side, whereas the side which is on the outside in FIG. 1 is referred to as the outer side.

The appliance 110 comprises a holder 126, over which the respiratory mask 114 can be stretched. The holder 126 comprises a curved sealing face 128, and when the respiratory mask 114 is stretched over the holder 126, the at least one sealing lip 122 is pressed against the sealing face 128 and sealed off with respect to it.

The appliances 110 of the embodiments in FIGS. 1 and 2 differ in the shape of the holder. While the holder 126 in FIG. 1 has a head shape, for example, such as the form of an above-described standard head, for example, the holder 126 according to FIG. 2 has a shape of a shell 130. This shell 130 may be, for example, a sphere shell segment or else may have another shell shape. Another shape as well, with a curved sealing face 128 corresponding at least approximately to a face, is possible in principle.

When the respiratory mask 114 is stretched over the holder 126, at least one fixing 132 of the respiratory mask 114 is fastened on the holder 126. The fixing 132 may comprise, for example, at least one belt, at least one webbing, or at least one fixing band, as represented illustratively in FIG. 1. To fasten the fixing 132 on the holder 126, the holder 126 has at least one fastening section 134. Whereas, in the case of the exemplary embodiment with the head shape as per FIG. 1, the fastening section 134 may be the back of a head, for example, a linkage 136 is provided illustratively in the case of the holder 126 as per the exemplary embodiment in FIG. 2, having a backward-projecting extension 138 which lies opposite the curved sealing face 128 and which is able to act as a fastening section 134.

The holder 126 in the exemplary embodiments shown, and also in other exemplary embodiments, may have, furthermore, at least one connecting element 140, allowing the holder 126 to be introduced fixedly or releasably into a cleaning basket, as described in detail below. In the case of the exemplary embodiment of FIG. 1, the connecting element 140 may be incorporated, illustratively, into the lower end of the head. In the case of the exemplary embodiment according to FIG. 2, the connecting element 140 may be, for example, a constituent part of the linkage 136, as for example a vertical carrier rod 142, in which case, for example, the extension 138 may extend vertically or at an angle backward to from the carrier rod 142, and where a lower end of the carrier rod 142 may accommodate, for example, the connecting element 140. This element may in this case be, for example, a thread or a similar connecting element. Also possible is a simple smooth end of the carrier rod 142, which is then inserted, for example, into a corresponding receptacle in a cleaning basket.

Figure 3:
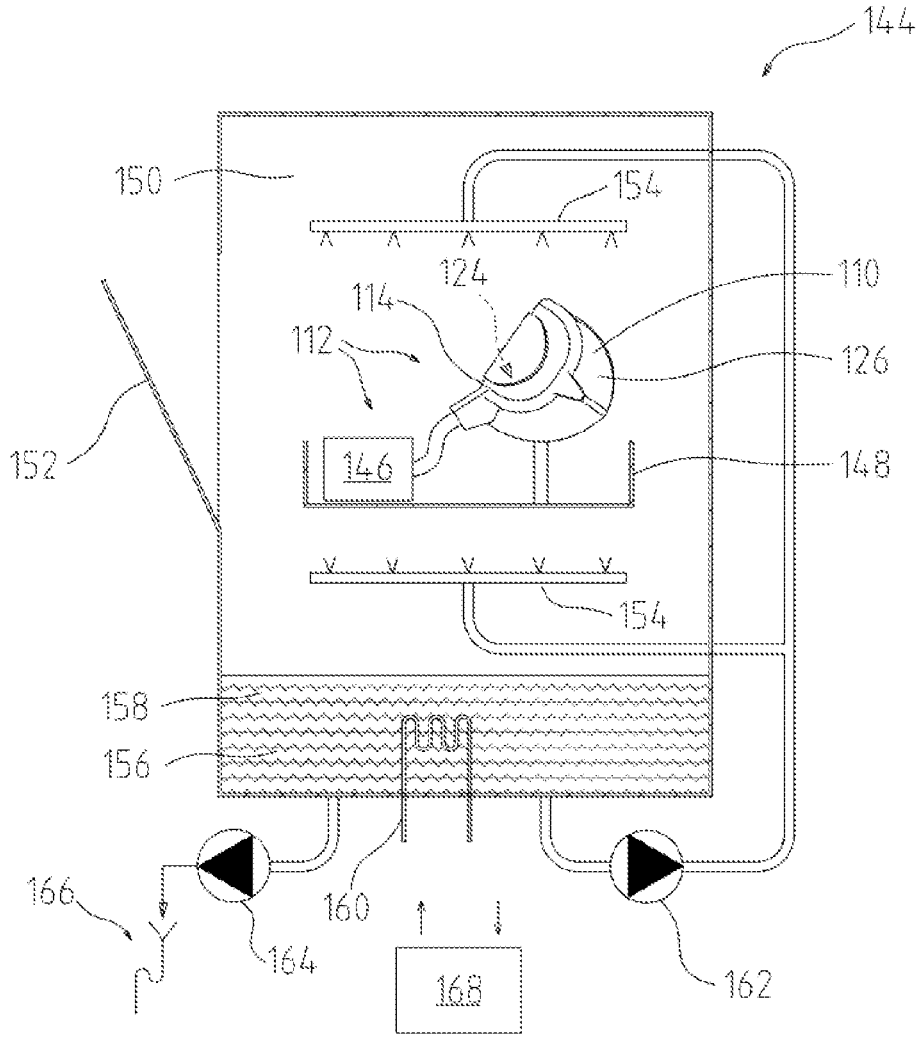
FIG. 3 shows an exemplary embodiment of a precleaning appliance.

FIG. 3 shows a precleaning appliance 144 for precleaning—that is, for implementing at least one precleaning step on—the breathing apparatus 112. To carry out the precleaning step, the respiratory mask 114 is first separated from at least one gas-conducting element 146, as for example from at least one pressurized-air breathing apparatus or breathing regulator. In this condition, as shown in FIGS. 1 and 2, the respiratory mask 114 is stretched over the holder 126, as described with reference to FIGS. 1 and 2. The appliance 110, comprising the holder 126 with the respiratory mask 114 stretched over it, is introduced into a cleaning basket 148, by connecting the holder 126 to this cleaning basket 148 releasably, for example. Subsequently, the at least one gas-conducting element 148 may be connected again to the respiratory mask 114, by means, for example, of connecting a pressurized-air breathing apparatus and/or breathing regulator to the port 118 again and closing this port imperviously. The interior 124 of the respiratory mask 114 is therefore imperviously closed. The cleaning basket 148 can be introduced into a precleaning chamber 150 of the precleaning appliance 144, being able to be closed off, for example, by a door 152, more particularly a flap. Other refinements of the precleaning appliance 144, however, are also possible in principle, said appliance being embodied preferably as a single-chamber programmable washing machine. For example, the precleaning appliance 144 may also be embodied as a hood-type washing machine.

In the precleaning chamber 150, the breathing apparatus 112 may be exposed via at least one exposure appliance 154 to precleaning fluid 156 from at least one precleaning tank 158. The precleaning tank 158 is arranged, for example, on the base of the precleaning chamber 150 and may be heatable, for example, by at least one heating appliance 160. The exposure appliance 154 may comprise, for example, nozzle arms, which are arranged above and below the cleaning basket 148 and which can be supplied, for example, from the precleaning tank 158 via a circulation pump 162. Provided optionally may be one or more filters, examples being coarse filters and/or fine filters, in order at least partly to purify the precleaning fluid 156 of the precleaning tank 158. Additionally provided may be at least one drain pump 164, which is able to discharge the precleaning tank 158 into a drain 166. The precleaning appliance 144, moreover, may have at least one controller 168 for controlling at least one precleaning step and/or at least one precleaning program with a plurality of steps.

In the precleaning appliance 144 represented illustratively in FIG. 3, no separate rinsing circuit and rinsing tank are shown, since this is not absolutely necessary for the precleaning step. In the precleaning step, for example, only in circulation mode, an outer side of the breathing apparatus 112 may be washed. Provided optionally, however, in addition, may be a rinsing tank, in which, independently of the precleaning tank 158, rinsing liquid can be prepared, in order to allow rinsing with a further exposure appliance. Further optionally, the rinsing could also be performed with the precleaning appliance shown, by discharging the tank 158 and filling it with fresh fluid for a rinsing step. This rinsing fluid could be sprinkled and/or sprayed over the precleaned breathing apparatus 112 by means of the circulation pump 162 and the exposure appliance 154. Further optionally, this rinsing fluid could be held in the precleaning tank 158 for the next, subsequent precleaning step. For possible refinements of a two-circuit system of this kind, reference may be made to the tanks 186, 202 of the appliance shown in FIG. 4 and described in more detail below, and also to the corresponding exposure appliance 176, which could also be implemented in the appliance according to FIG. 3, as the skilled person will recognize.

Figure 4:
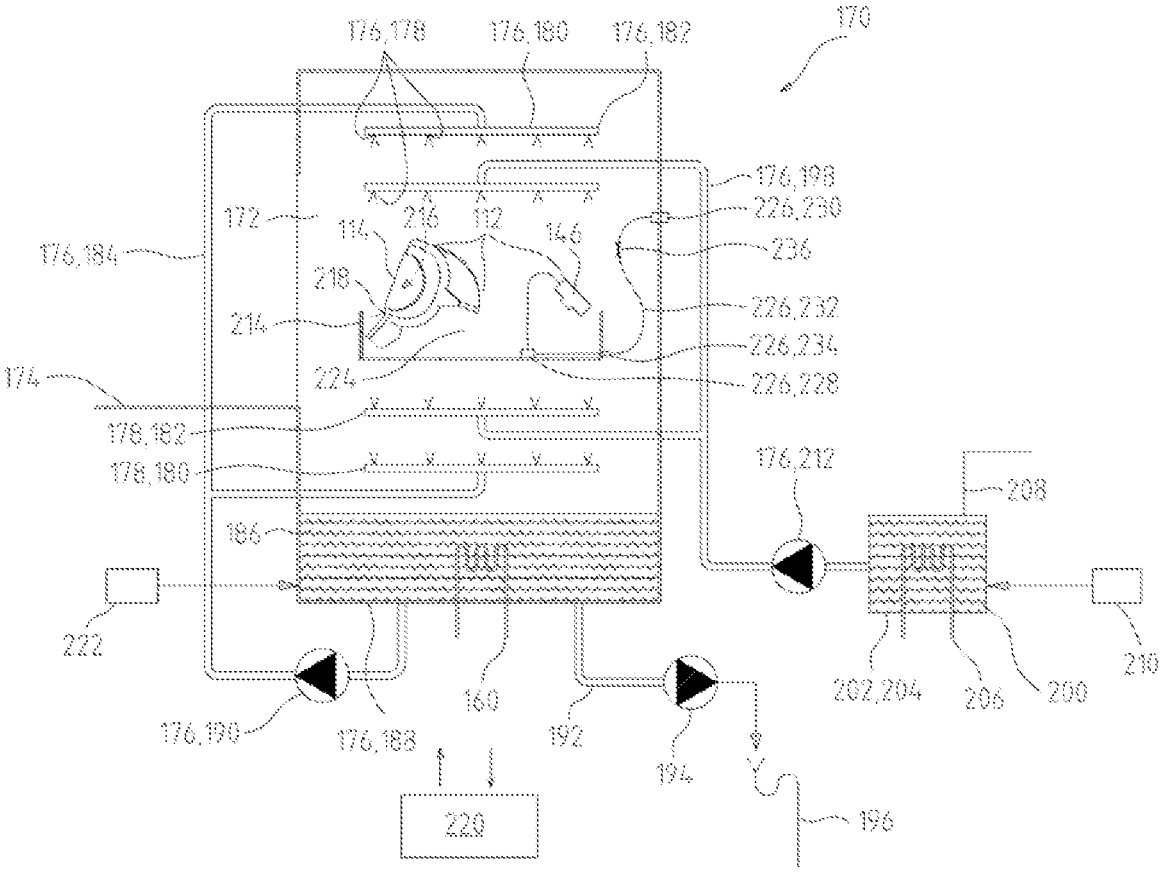
FIG. 4 shows an exemplary embodiment of a primary cleaning appliance.

FIG. 4, in a sectional representation in analogy to FIG. 3, represents an exemplary embodiment of a primary cleaning appliance 170, which is configured for implementing at least one primary cleaning step on one or more breathing apparatuses 112. Again, the primary cleaning appliance 170 may be designed, for example, as a washing machine, in which case it is possible, for example, for commercial dishwasher machines to be converted accordingly, examples being under-counter washing machines from MEIKO Maschinenbau GmbH & Co. KG, 77652 Offenburg, Germany. The primary cleaning appliance 170 comprises a primary cleaning chamber 172. The primary cleaning chamber 172 may be opened, for example, by a door 174, as for example again a flap, a swing door or a push door, and/or by another opening apparatus. Alternatively or additionally, the primary cleaning chamber 172 may also again be configured in whole or in part as a cleaning chamber covered by a hood. In the exemplary embodiment represented in FIG. 4, for example, the washing machine is designed as a front-loading washing machine, as is the precleaning appliance 144 of FIG. 3. Other refinements as well, however, are possible.

The primary cleaning appliance 170 again has at least one exposure appliance 176, also referred to as fluid facility, for exposing the breathing apparatuses 112 accommodated in the primary cleaning chamber 172 to one or more primary cleaning fluids. For example, the exposure appliance 176 may again—in analogy to the refinement of the precleaning appliance 144 as per FIG. 3—comprise one or more nozzles 178, which may be arranged, for example, above and/or below the breathing apparatuses 112 and/or at other locations within the primary cleaning chamber 172, such as on one or more side walls, for example. The exposure appliance 176 may for example, as in the exemplary embodiment represented in FIG. 4, have a wash nozzle system 180, with, for example, one or more nozzle arms having a plurality of nozzles 178 and mounted pivotably and/or rotatably, preferably, and accommodated above and/or below the breathing apparatuses 112. Alternatively or additionally, the exposure appliance 176 may also comprise a rinse nozzle system 182, with, for example, one or more rinse nozzle arms, which are preferably again mounted rotatably and/or pivotably and which, for example, may again be arranged above and/or below the breathing apparatuses 112. Other arrangements and/or refinements, however, are also possible in principle.

Furthermore, in analogy to the precleaning appliance 144 in FIG. 3, the exposure appliance 176 may again comprise one or more further elements, examples being one or more pipelines, one or more pumps and/or one or more tanks. For example, in the exemplary embodiment illustrated, there is at least one wash line system 184 provided, for exposing the wash nozzle system 180 to primary cleaning fluid 186, in turn for example cleaner solution, from one or more primary cleaning tanks 188. For example, the primary cleaning tank 188 may be provided in the base region of the primary cleaning chamber 172 and/or may in turn be connected in some other way to the primary cleaning chamber 172, allowing primary cleaning fluid 186, after acting on the breathing apparatuses 112, to flow and/or drip back into the primary cleaning tank 188 again. To expose the wash nozzle system 184 to the primary cleaning fluid 186 from the primary cleaning tank 188, the exposure appliance 176 may additionally have one or more circulation pumps 190. Additionally there may be one or more heating elements 192 provided, in order to heat the primary cleaning fluid 186 of the primary cleaning tank 188 and/or of other tanks, in the form, for example, again of a wash tank heater within the primary cleaning tank 188. The primary cleaning tank 188 may again be dischargeable into a drain 196, by way, for example, of a drain line 192 and optionally by way of a drain pump 194.

The primary cleaning fluid 186 may, particularly in a circulation mode, be applied to the breathing apparatuses 112, by sprinkling and/or spraying the primary cleaning fluid 186 from the primary cleaning tank 188 onto the breathing apparatuses 112 via the wash nozzle system 180, before then running off or dripping off back into the primary cleaning tank 188, to be used anew from that tank. Provided optionally may be one or more filters, examples being coarse filters and/or fine filters, in order at least partly to purify the primary cleaning fluid 186 of the primary cleaning tank 188.

The rinse nozzle system 182 may be exposed to a further primary cleaning fluid 200, as for example a rinsing liquid, for example, via at least one rinse line system 198. In this context, FIG. 4 shows an optional refinement in which the primary cleaning appliance 170 is designed as a two-circuit system. Accordingly, the further primary cleaning fluid 200 is provided from, for example, a separate tank, which in the exemplary embodiment represented is designed as rinsing tank 202, which is formed separately from the primary cleaning tank 188. The rinsing tank 202 may be considered to be a further primary cleaning tank 204, since the rinsing in the primary cleaning appliance 170 according to FIG. 4 is still a constituent part of the primary cleaning step. For example, this rinsing tank 202 may be embodied as a boiler and may comprise, for example, a rinsing-tank heater 206. Alternatively or additionally to a rinsing-tank heater 206, other kinds of heating elements may also be provided for the further primary cleaning fluid 200, especially the rinsing fluid or the rinsing liquid, examples being one or more traversed heaters. The same is also true of the primary cleaning fluid 186 in the primary cleaning tank 188. The rinsing tank 202 may be charged with primary cleaning fluid 200—fresh water, for example—via one or more feeds 208. Moreover, as in the primary cleaning tank 188 and also in the precleaning appliance 144 as well, there may in each case be one or more metering systems 210 provided, in order for one or more additives to be admixed to the respective cleaning fluid—for example, cleaner concentrates and/or rinse-aid concentrates and/or disinfectant concentrates.

The rinse nozzle system 198 may be caused to act preferably in simple operation, in other words not in circulation mode, so that the breathing apparatus 112 is exposed only once to the rinsing fluid/primary cleaning fluid 200 from the rinsing tank 202. For the exposure, the exposure appliance 176 may comprise, for example, one or more pressure-raising pumps 212.

The primary cleaning of the breathing apparatuses 112 in the primary cleaning appliance 170 according to FIG. 4 may be accomplished, for example, by—as described in more detail below—releasing the respiratory masks 114 from the holder 126 and placing them loose into one or more cleaning baskets 214. An inner side of the respiratory masks 114, pointing to the respective interior 124, is in this case no longer covered by a holder 126, and so this respective inner side, designated symbolically in FIG. 4 with the reference numeral 216, is accessible, as is an outer side 218, for the primary cleaning fluid 186/200. With the cleaning basket 214, the breathing apparatuses can then be introduced into the primary cleaning chamber 172, and the door 174 can be closed. Then it is possible preferably to initiate a primary cleaning program, which can be controlled, for example, via a controller 220, as for example a central machine controller or else a decentralized controller. In this case it is possible, for example, first to fill the primary cleaning tank 188 by means of the rinse nozzle system 182, with primary cleaning fluid 186 and/or with a precursor of this primary cleaning fluid 186, fresh water for example, more particularly demineralized fresh water. This can then be conditioned within the primary cleaning tank 188, by the admixing, for example, of one or more additives via a metering system 222 and/or by heating by means of the heating element 192. Alternatively or additionally, the primary cleaning fluid 186 may also have remained after a clear-rinse program of a preceding cleaning cycle in the primary cleaning tank 188, in order to be used as primary cleaning fluid 186 and/or as a constituent part thereof in a subsequent cleaning cycle, since even after the breathing apparatus 112 has been exposed, rinsing fluid generally has a comparatively high degree of purity.

The breathing apparatus 112 may subsequently be cleaned, more particularly washed, preferably in circulation mode, in one or more primary cleaning program steps. Here it is possible for adhering impurities to be removed from the breathing apparatuses 112, and/or the breathing apparatuses 112 may be sanitized.

Subsequently it is possible to carry out one or more rinsing steps, which may likewise still be regarded as a constituent part of the primary cleaning step and/or primary cleaning program. For this purpose, the primary cleaning tank 188 may be discharged preferably via the drain line 192 and the drain pump 194. The rinsing tank 202 may already have been filled beforehand with the further primary cleaning fluid 202, which acts as rinsing fluid, such as with fresh water with or without additives, for example—with demineralized fresh water, for example. It is possible subsequently to admix one or more additives by way of the metering system 210, and/or the cleaning fluid 200 as rinsing fluid may be heated by means of the rinsing tank heater 206 and/or a traversed heater. The rinsing fluid 200 preconditioned in this way can then be applied to the breathing apparatuses 112 in the at least one rinsing step by way of the rinse nozzle system 182, and so these apparatuses are rinsed and/or clear-rinsed. After the at least one rinsing step, there may optionally again be at least one drying step, which may be passive, by simple waiting, or which may also be actively supported, for example using at least one drying fan and/or some other kind of drying appliance of the primary cleaning appliance 170. Subsequent to the optional drying step, the door 174, which up to that point has optionally been preferably locked, can be automatically released and/or opened. The entire program may be controlled, for example, by the controller 220, wherein more programs may also be selectable.

It is pointed out that the exemplary embodiment of the primary cleaning appliance 170 represented in FIG. 4, and also the exemplary embodiment of the precleaning appliance 144 represented in FIG. 3, represent merely one of a plurality of different exemplary embodiments. Accordingly, individual or two or more or else all of the elements described above may also be implemented in a different context. For example, the fluid circuits represented may be modified, and the respective cleaning chambers may be designed in a different way—rotatably and/or pivotably, for example.

As represented above, for the at least one primary cleaning step, the at least one breathing apparatus 112 within the primary cleaning chamber 172 is placed preferably in at least one cleaning basket 214. Another holder is also possible, preferably a form of storage where the inner side 216 of the at least one respiratory mask 114 is freely accessible for the respective primary cleaning fluid 186, 200. The cleaning basket 214 may, furthermore, have one or more small-parts baskets 224, which optionally may also be provided in the cleaning basket 148 in the case of the refinement in FIG. 3.

Additionally there may be one or more fixings provided for the at least one breathing apparatus, for positioning of one or more components of the breathing apparatus 112, for example.

In order to prevent the at least one gas-conducting element 146 of the breathing apparatuses 112—for example, a breathing regulator, a gas line of the breathing regulator, a respiratory regulator, a pressurized-air breathing apparatus or else other gas-conducting components—coming into contact with the at least one primary cleaning fluid 186, 200 and contaminating the inner sides thereof with this cleaning fluid, provision is made for the at least one gas-conducting element 146 to be exposed to pressurized gas, optionally, during one or more program steps of the primary cleaning taking place in the primary cleaning appliance 170. For this purpose, the primary cleaning appliance 170 preferably has at least one pressure exposure appliance 226. This pressure exposure appliance 226 is configured to expose the at least one gas-conducting element 146 to pressurized gas. For this purpose, the pressure exposure appliance 226 has at least one pressure connection 228, which is connectable to the gas-conducting element 146 in such a way that such gas exposure can take place—compressed-air exposure, for example. In the exemplary embodiment represented, this pressure connection 228 is formed illustratively as a constituent part of the cleaning basket 214. Alternatively or additionally, however, the pressure connection 228 may also be provided at other points of the primary cleaning appliance 170, as for example in the inside of the primary cleaning chamber 172. In the exemplary embodiment represented, for example, the pressure connection 228 may be embodied as a connection for a breathing regulator. The pressure connection 228 in this case may be embodied generally, in this exemplary embodiment or else in other exemplary embodiments, in a manner such that it is connectable to a plurality of kinds of gas-conducting elements 146—to different types and/or different kinds, for example. For example, the pressure connection 228 may comprise a plurality of adapters and/or the primary cleaning appliance 170 may be supplied with an adapter set comprising a plurality of adapters for different pressure connections 228, thus producing a high flexibility in terms of the nature of the gas-conducting elements 146. For example, the pressure connection 228 may comprise a quick-fit coupling. In order to expose the pressure connection 228 and the gas-conducting element 146 to pressurized gas, compressed air for example, the primary cleaning appliance 170 may comprise at least one internal and/or at least one external compressed-gas source, in the exemplary embodiment represented or else in other refinements. They may, for example, be connected to at least one external pressure connection 230, which is connectable to the pressure connection 228 by way of a pressurized-gas line 232, for example. If, as shown in FIG. 4, the pressure connection 228 is connected to the cleaning basket 214, there may be one or more couplings 234 provided, in order to enable reversible withdrawal of the cleaning basket 214. Additionally there may be one or more valves 236 provided in the pressurized gas line 232. These valves 236 may be controlled by the controller 220, for example. In this way or some other way, therefore, for example, the exposure to pressure of the at least one gas-conducting element 146 may take place in a controlled way by means of the pressure exposure appliance 226 in this or else in other exemplary embodiments of the invention, by the exposure to pressure taking place, for example, in a targeted way before the start of exposure of the breathing apparatuses 112 to primary cleaning fluid 186, 200. Alternatively or additionally, the pressure exposure may also take place only in one or more program steps, as for example only in one or more program steps during which the breathing apparatuses 112 are exposed to primary cleaning fluid 186, 200. Optionally the exposure to pressurized gas, for example compressed air, may conversely be switched off and/or take place in another form, with altered pressure, for example, during other program steps. In this way the pressure exposure may be adapted, for example, in the various program steps.

Figure 5:
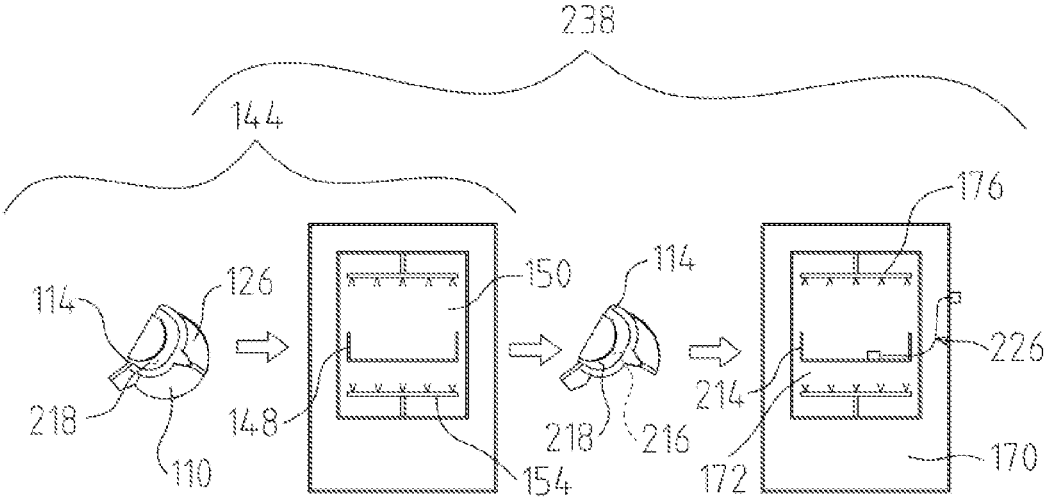
FIG. 5 shows components of an exemplary embodiment of a cleaning system for cleaning personal protective equipment.

FIG. 5 shows, symbolically and illustratively, components of a cleaning system 238 of the invention for cleaning personal protective equipment. This cleaning system 238 first of all comprises at least one appliance 110 for cleaning at least one breathing apparatus, corresponding, for example, to the exemplary embodiments in FIG. 1 or 2, or in accordance with other embodiments, having a holder 126 onto which at least one respiratory mask 114 can be stretched. The appliance 110, jointly with a precleaning appliance 144, corresponding for example to the exemplary embodiment of FIG. 3, forms a precleaning appliance 144. The precleaning appliance 144, jointly with a primary cleaning appliance 170, corresponding for example to the refinement in FIG. 4, ultimately forms the cleaning system 238. For cleaning of the breathing apparatus 112 and/or of other constituent parts of the personal protective equipment, the respiratory mask 114 is first stretched over the holder 126, introduced into the precleaning chamber 150, and exposed there to the precleaning fluid 156, in order to clean the outer side 218 of the respiratory mask 114 to remove adhering purities; the inner side 216 is not cleaned. After this precleaning step, the respiratory mask 114 is released from the holder 126 and conveyed into the primary cleaning chamber 172 of the primary cleaning appliance 170, jointly with the at least one gas-conducting element 146, to be subjected therein to a primary cleaning step on all sides, in other words on the outer side 218 and the inner side 216. Preferably, as stated above, the gas-conducting element 146 in this case is exposed to pressurized gas, more particularly compressed air, in such a way that no primary cleaning fluid 186, 200 is able to get into the inside of the at least one gas-conducting element 146. In this primary cleaning step, which may also comprise at least one disinfection, the outer side 218 and the inner side 216 of the respiratory mask 114 are cleaned, and so adhering perspiration, for example, is also washed off from the inner side 216. As a result of the separation of the primary cleaning step from the precleaning step, however, the ability of toxic impurities to get from the outer side 218, by way of the precleaning fluid 156, to the inner side 216 is effectively prevented. Also prevented is the passage of toxic impurities through entrainment into the primary cleaning step and the contamination thereby of the primary cleaning fluid therein.

Figure 6:
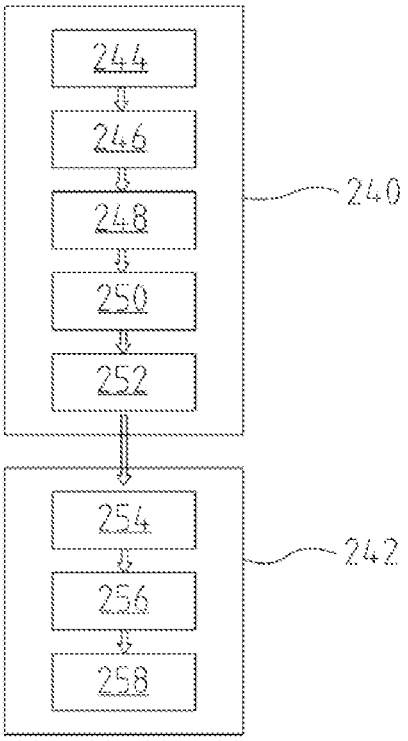
FIG. 6 shows a flow diagram of an exemplary embodiment of a method for cleaning at least one breathing apparatus.

FIG. 6 represents schematically one embodiment of a method of the invention for cleaning at least one breathing apparatus 112. The method comprises at least one precleaning step 240 and at least one primary cleaning step 242.

In a first step, identified in FIG. 6 with the reference numeral 244, the breathing apparatus 112 is provided in a contaminated state. For this, for example, a fire department operative may end or interrupt a deployment, and may release at least one gas-conducting element 146, a breathing regulator for example, from the respiratory mask 114; in practice, the respiratory mask 114 can still be left on the face for a short time for the purpose of acclimatization. Additionally, the fire department operative may pull the respiratory mask 114 from the face in such a way that his gloves contact only the externally contaminated outer side 218. The respiratory mask 114 may be placed into a transport box—not represented in the figures—in which the respiratory masks 114 are already stretched over holders 126, for example. Correspondingly, a further method step of the method according to FIG. 6, denoted by reference numeral 246, comprises the provision of the at least one holder 126 for the at least one respiratory mask 114, with the holder, as stated above with reference to FIGS. 1 and 2, having at least one curved sealing face 128. The method additionally comprises a method step 248, in which the at least one respiratory mask 114 is stretched over the holder 126. This stretching is accomplished in such a way that the at least one sealing lip 122 of the respiratory mask 114 lies on the curved sealing face 128 of the holder 126 and closes off the interior 124 of the respiratory mask 114, in an airtight manner, for example.

The gas-conducting elements 146 remain preferably together—for example, by leaving breathing regulators on the pressurized-air breathing apparatus, and the pressurized-gas bottle as well. These gas-conducting elements 146 may likewise be packed into one or more transport boxes, which for example, but not necessarily, may be designed separately from the at least one transport box for the respiratory masks 114. The transport boxes may for example be closed in an airtight way for transport.

In the so-called black area of the fire department, the dirty working area, the transport boxes can then be opened. This may optionally take place using personal protective equipment such as mouth protection and gloves, for example. The subsequent step is a method step 250, in which the at least one holder 126 with the respiratory mask 114 stretched thereover is introduced into the precleaning chamber 150 of the precleaning appliance 144, by means of the at least one cleaning basket 148, for example. Additionally it is possible for one or more gas-conducting elements 146 to be introduced into the precleaning chamber 150. For example, in each case four pressurized-air breathing apparatuses, including breathing regulators and pressurized-gas bottles, and also a corresponding number of respiratory masks 114 on the corresponding holders 126 may be taken from the transport box and placed in the precleaning chamber 150 of the precleaning appliance 144. The breathing regulators may be connected again to the respiratory masks 114, so that not only the gas-conducting elements 146 but also the respiratory masks 114 are closed to the outside, as stated above.

Subsequently, in method step 252, the at least one outer side 218 of the at least one respiratory mask 114 is exposed in the precleaning chamber 150 to the at least one precleaning fluid 156. Additionally, optionally, the gas-conducting elements 146 in this case may also be exposed to the precleaning fluid 156. This exposure takes place preferably at least partly in a circulation procedure, in which case, for example, the precleaning fluid 156 may be left in the precleaning tank 158 for a plurality of precleaning cycles. The at least one inner side 216 of the at least one respiratory mask 114 is in this case not contacted with the precleaning fluid 156, because the respiratory mask 114 is stretched over the respective holder 126. This affectively avoids contamination being entrained from the outer side 218 to the inner side 216.

Method step 252 may, as stated above, also have a multistage configuration. Accordingly, the at least one precleaning fluid 156 may also comprise a plurality of precleaning fluids 156, in which case, for example, at least one of these two or more precleaning fluids, also designated the primary precleaning fluid, is used for a primary precleaning step, carried out preferably in circulation mode, and subsequently at least one other of these two or more precleaning fluids, also designated the rinsing precleaning fluid, may be used for at least one rinsing precleaning step, also denoted as clear-rinse step. The clear-rinse step here takes place preferably not in circulation mode, and so the exposure occurs only once, with remnants of the primary precleaning fluid and also toxins and contaminants possibly contained therein being washed off by the rinsing precleaning fluid. The rinsing precleaning fluid may comprise fresh water, for example. The rinsing precleaning fluid may be prepared, for example, in a separate tank or boiler.

After the end of the exposure, the precleaning step 240 is at an end. It may, however, comprise further method steps.

The at least one precleaning step 240 is followed by the at least one primary cleaning step 242. This step first comprises the releasing of the at least one respiratory mask 114 from the at least one holder 126 in step 254. The at least one respiratory mask 114 is subsequently introduced, in method step 256, into the primary cleaning chamber 172 of the primary cleaning appliance 170. There, in method step 258, the respiratory mask 114 is exposed to the at least one primary cleaning fluid 186, 200, including the inner side 216, which now is no longer sealed off by the holder 126. In this case it is possible, for example, for perspiration to be washed off from the inner side 216. At the same time, in the at least one primary cleaning step and in particular in the step 258, it is also possible for one or more gas-conducting elements 146 to be cleaned, as described above, with these gas-conducting elements 146 preferably undergoing exposure to pressurized gas, so that no primary cleaning fluid 186, 200 is able to reach the inside of these gas-conducting elements 146.

In the primary cleaning step 242 there may optionally also be a disinfection. Following implementation of the primary cleaning step 242, the elements may either be dried still in the primary cleaning chamber 170 or may be dried externally. For example, pressurized-air breathing apparatuses may be hung up subsequently to dry and/or placed into a drying cabinet, and pressurized-gas bottles may be dried manually or else stored for drying. The holders 126, the heads for example, may be cleaned after the implementation of the precleaning step 240, optionally jointly with the at least one transport box, in the precleaning appliance 144, for example, or else otherwise. They may subsequently be dried, before being conveyed, for example, back together onto the vehicles, ready for the next deployment.

LIST OF REFERENCE NUMERALS

110 appliance for cleaning at least one breathing apparatus
112 breathing apparatus
114 respiratory mask
116 viewing window
118 port
120 exhalation valve
122 sealing lip
124 interior
126 holder
128 sealing face
130 shell
132 fixing
134 fastening section
136 linkage
138 extension
140 connecting element
142 carrier rod
144 precleaning appliance
146 gas-conducting element
148 cleaning basket
150 precleaning chamber
152 door
154 exposure appliance
156 precleaning fluid
158 precleaning tank
160 heating appliance
162 circulating pump
164 drain pump
166 drain
168 controller
170 primary cleaning appliance
172 primary cleaning chamber
174 door
176 exposure appliance
178 nozzles
180 wash nozzle system
182 rinse nozzle system
184 wash line system
186 primary cleaning fluid
188 primary cleaning tank
190 circulating pump
192 drain line
194 drain pump
196 drain
198 rinse line system
200 further primary cleaning fluid
202 rinsing tank
204 further primary cleaning tank
206 rinsing-tank heater
208 entry
210 metering system
212 pressure increase pump
214 cleaning basket
216 inner side
218 outer side
220 controller
222 metering system
224 small-parts basket
226 pressure exposure appliance
228 pressure connection
230 external pressure connection
232 pressurized-gas line
234 coupling
236 valve
238 cleaning system
240 precleaning step
242 primary cleaning step
244 provision of the breathing apparatus
246 provision of the holder
248 stretching of the respiratory mask over a holder
250 introduction of the holder with the respiratory mask into the precleaning chamber
252 exposure to precleaning fluid
254 release of the respiratory mask from the holder
256 introduction of the respiratory mask into the primary cleaning chamber
258 exposure of the respiratory mask to primary cleaning fluid

The invention claimed is:

1. A method for cleaning at least one breathing apparatus, comprising at least one respiratory mask, wherein the method comprises at least one precleaning step, the at least one precleaning step comprising the following substeps:

a) providing the at least one breathing apparatus in an externally contaminated state;

b) providing at least one holder for the at least one respiratory mask, the at least one holder having at least one curved sealing face;

c) stretching the at least one respiratory mask onto the at least one holder such that at least one sealing lip of the at least one respiratory mask lies on the at least one curved sealing face and closes off an interior of the at least one respiratory mask;

d) introducing the at least one holder with the at least one respiratory mask into a precleaning chamber; and e) exposing an outer side of the at least one respiratory mask in the precleaning chamber to at least one precleaning fluid.

2. The method as claimed in claim 1, wherein the at least one holder has a shape selected from the group consisting of: a head shape; a face shape; a sphere shape; a sphere segment shape; a sphere shell shape; a freeform surface shell.

3. The method as claimed in claim 1, wherein the at least one curved sealing face is a continuous sealing face which is configured to close off the interior completely, together with the at least one sealing lip.

4. The method as claimed in claim 1, wherein the at least one holder additionally has at least one fastening section for fastening at least one fixing of the at least one respiratory mask on the at least one holder.

5. The method as claimed in claim 1, wherein the exposing in step e) takes place in such a way that the interior of the at least one respiratory mask remains free from cleaning fluid.

6. The method as claimed in claim 1, wherein method step e) is carried out at least partly in a circulation mode of the at least one precleaning fluid.

7. The method as claimed in claim 1, wherein the at least one precleaning fluid comprises at least one primary precleaning fluid and at least one rinsing precleaning fluid, wherein method step e) comprises at least one primary precleaning step and at least one rinsing precleaning step, wherein, in the primary precleaning step, the outer side of the at least one respiratory mask is exposed to the at least one primary precleaning fluid, and wherein, in the rinsing precleaning step, the outer side of the at least one respiratory mask is exposed to the at least one rinsing precleaning fluid.

8. The method as claimed in claim 1, wherein the at least one holder with the at least one respiratory mask is introduced into the precleaning chamber in a cleaning basket.

9. The method as claimed in claim 8, wherein the at least one holder is selected from the group consisting of: a holder fixedly connected to the cleaning basket;

a holder releasably connectable to the cleaning basket and connected before method step d), together with the at least one respiratory mask stretched thereon, to the cleaning basket.

10. The method as claimed in claim 1, further comprising at least one primary cleaning step, which is carried out after the precleaning step and comprises the following substeps:

i) releasing the at least one respiratory mask from the at least one holder;

ii) introducing the at least one respiratory mask into a primary cleaning chamber; and iii) exposing the at least one respiratory mask, including an inner side of the at least one respiratory mask that faces the interior, to at least one primary cleaning fluid.

11. The method as claimed in claim 10, wherein the at least one respiratory mask, in the primary cleaning step, is cleaned jointly with at least one gas-conducting element of the at least one breathing apparatus, and wherein, in method step the gas-conducting element is exposed to a pressurized gas, so that the primary cleaning fluid does not reach the inside of the gas-conducting element.

12. A precleaning appliance for precleaning personal protective equipment, the precleaning appliance comprising:

at least one precleaning chamber, at least one appliance for cleaning at least one breathing apparatus, the at least one breathing apparatus comprising at least one respiratory mask, the appliance, having at least one holder, and at least one cleaning basket, wherein the at least one holder is selected from a group consisting of a holder fixedly connected to the at least one cleaning basket; and a holder releasably connectable to the cleaning basket, wherein the at least one holder has at least one curved sealing face, the at least one respiratory mask being stretchable onto the at least one holder in such a way that a sealing lip of the at least one respiratory mask lies on the at least one curved sealing face and closes off an interior of the at least one respiratory mask, wherein the at least one appliance with the at least one respiratory mask stretched onto the at least one holder is introduced into the at least one precleaning chamber, and at least one exposing appliance for exposing an outer side of the at least one respiratory mask to at least one precleaning fluid in the at least one precleaning chamber.

13. A cleaning system for cleaning at least one breathing apparatus, the cleaning system comprising:

at least one precleaning appliance at least one precleaning chamber, at least one appliance for cleaning at least one breathing apparatus, the at least one breathing apparatus comprising at least one respiratory mask, the at least on appliance, having at least one holder, and at least one cleaning basket, wherein the at least one holder is selected from a group consisting of a holder fixedly connected to the at least one cleaning basket, and a holder releasably connectable to the cleaning basket, wherein the at least one holder has at least one curved sealing face, the at least one respiratory mask being stretchable onto the at least one holder in such a way that a sealing lip of the at least one respiratory mask lies on the at least one curved sealing face and closes off an interior of the at least one respiratory mask, wherein the at least one appliance with the at least one respiratory mask stretched onto the at least one holder is introduced into the at least one precleaning chamber, and at least one exposing appliance for exposing an outer side of the at least one respiratory mask to at least one precleaning fluid in the at least one precleaning chamber at least one primary cleaning appliance, wherein the at least one primary cleaning appliance has at least one primary cleaning chamber, wherein at least one respiratory mask of the at least one breathing apparatus is introduced, after precleaning in the precleaning appliance, released from the at least one holder, into the at least one primary cleaning chamber, the at least one primary cleaning appliance additionally having at least one exposing appliance for exposing the at least one respiratory mask, including an inner side of the at least one respiratory mask that faces the interior, to at least one primary cleaning fluid.

14. An appliance for cleaning at least one breathing apparatus, the at least one breathing apparatus comprising:

at least one respiratory mask, the appliance, having at least one holder, and at least one cleaning basket, wherein the at least one holder is selected from a group consisting of: a holder fixedly connected to the at least one cleaning basket and a holder releasably connectable to the cleaning basket, wherein the at least one holder has at least one curved sealing face, the at least one respiratory mask being stretchable onto the at least one holder in such a way that a sealing lip of the at least one respiratory mask lies on the at least one curved sealing face and closes off an interior of the at least one respiratory mask.

15. The appliance as claimed in claim 14, wherein the at least one holder additionally has at least one fastening section for fastening at least one fixing of the at least one respiratory mask on the at least one holder.

* * * * *